US009708900B2

(12) United States Patent
Veltman

(10) Patent No.: US 9,708,900 B2
(45) Date of Patent: Jul. 18, 2017

(54) METHOD OF AND A DEVICE FOR DETERMINING OPERATIONAL PARAMETERS OF A COMPUTATIONAL MODEL OF BOREHOLE EQUIPMENT, AN ELECTRONIC CONTROLLER AND BOREHOLE EQUIPMENT

(71) Applicant: COFELY EXPERTS B.V., Amsterdam (NL)

(72) Inventor: Andre Veltman, Culemborg (NL)

(73) Assignee: Cofely Experts B.V., Amsterdam (NL)

( * ) Notice: Subject to any disclaimer, the term of this patent is extended or adjusted under 35 U.S.C. 154(b) by 0 days.

(21) Appl. No.: 14/653,827

(22) PCT Filed: Dec. 20, 2013

(86) PCT No.: PCT/NL2013/050932
§ 371 (c)(1),
(2) Date: Jun. 18, 2015

(87) PCT Pub. No.: WO2014/098598
PCT Pub. Date: Jun. 26, 2014

(65) Prior Publication Data

US 2015/0322766 A1 Nov. 12, 2015

(30) Foreign Application Priority Data

Dec. 20, 2012 (NL) ..... 2010033

(51) Int. Cl.
*G01V 3/00* (2006.01)
*E21B 44/00* (2006.01)

(52) U.S. Cl.
CPC ..... *E21B 44/00* (2013.01)

(58) Field of Classification Search
CPC ..... E21B 21/08; E21B 47/06; E21B 7/068; E21B 47/12; E21B 45/00; E21B 44/005; E21B 7/04
(Continued)

(56) References Cited

U.S. PATENT DOCUMENTS 5,117,926 A 6/1992 Worrall et al.
5,721,376 A * 2/1998 Pavone ..... E21B 47/0006 175/40
(Continued)

OTHER PUBLICATIONS

PCT Written Opinion issued for PCT/NL2013/050932 filed on Dec. 20, 2013 in the name of Cofely Experts B.V. Mail date: Feb. 17, 2014.
(Continued)

*Primary Examiner* — Dhaval Patel
(74) *Attorney, Agent, or Firm* — Steinfl + Bruno LLP

(57) ABSTRACT

A method of and a device for computer controlled determination of operational parameters of a computational model of borehole equipment for drilling a borehole in an earth formation are described. The borehole equipment has a rotational drive system, a drill string having a bottom hole assembly and a top end coupled to the rotational drive system, and a speed controller for controlling rotational drive speed of the drive system. The drive system is controlled such that a torque provided by the drive system while driving the drill string is varied over a time period. From the varying torque and rotational top end drive speed of the drill string an estimated torque-speed transfer function is obtained and matched with a torque-speed transfer function computed from the computational model of the borehole equipment. The operational parameters are determined from the matched estimated torque-speed transfer function and the computed torque-speed transfer function.

24 Claims, 10 Drawing Sheets

(58) Field of Classification Search
USPC ..... 340/853.6, 854.1, 855.4; 702/6, 9
See application file for complete search history.

(56) References Cited

U.S. PATENT DOCUMENTS 6,662,110 B1 * 12/2003 Bargach ..... E21B 44/00 175/45
2012/0255778 A1 * 10/2012 Reckmann ..... E21B 47/0006 175/26

OTHER PUBLICATIONS

PCT International Preliminary Report on Patentability issued for PCT/NL2013/050932 filed on Dec. 20, 2013 in the name of Cofely Experts B.V. Mail date: Jun. 23, 2015.
PCT International Search Report issued for PCT/NL2013/050932 filed on Dec. 20, 2013 in the name of Cofely Experts B.V. Mail date: Feb. 17, 2014.

* cited by examiner 62
63
64
$A_{HF}$
$A_{LF}$
$A_{LF+HF}$
t [s]
2
1
0
-1
-2
0
20
40
60
80
100
120

METHOD OF AND A DEVICE FOR DETERMINING OPERATIONAL PARAMETERS OF A COMPUTATIONAL MODEL OF BOREHOLE EQUIPMENT, AN ELECTRONIC CONTROLLER AND BOREHOLE EQUIPMENT

CROSS REFERENCE TO RELATED APPLICATIONS

The present application is the U.S. national stage entry of International Patent Application No. PCT/NL2013/050932, filed internationally on Dec. 20, 2013, which, in turn, claims priority to Dutch Patent Application No. 2010033, filed on Dec. 20, 2012.

TECHNICAL FIELD

The present invention generally relates to borehole equipment for drilling a borehole in an earth formation. More specifically, the present invention relates to a method of and a device for determining operational parameters of a representative computational model of borehole equipment for drilling a borehole in an earth formation, inter alia for determining tuning parameters for use in a speed controller of such borehole equipment, as well as borehole equipment equipped with and operating in accordance with this method, device or speed controller.

BACKGROUND

The term borehole generally designates the result of a drilling operation in the earth, either vertically, horizontally and/or deviated using a drill string, comprising a drill bit at its lower end. At its upper end or top end, the drill string is driven by a drive system at the earth surface, called a top drive or rotary table. The top drive or rotary table is driven by an electric motor, or any other type of drive motor, providing a rotational movement to the drill bit in the borehole.

Typically, the drill string is a structure of a plurality of tubulars or pipes, threadedly connected to each other. A typical drill string may have a length of several hundreds or thousands of meters.

The lower part of the drill string is called the bottom hole assembly, BHA, at which the cutting tool for drilling the borehole, also called the drill bit, connects.

The drill string is hollow, such that drilling fluid can be pumped down towards the bottom hole assembly and through nozzles in the bit, for lubrication purposes. The drilling fluid is circulated back up the annulus, i.e. the space between the outer circumference of the drill string and the borehole wall, to transport cuttings from the drill bit to the earth surface.

A borehole may be drilled for many different purposes, including the extraction of water or other liquid (such as oil) or gases (such as natural gas), as part of a geotechnical investigation, environmental site assessment, mineral exploration, temperature measurement or as a pilot hole for installing piers or underground utilities, for example.

The bottom hole assembly is rigid in torsional direction as it is relatively short and thick-walled. In use, the bottom hole assembly experiences lateral deflections due to compressive force. The drill string is a slender and flexible structure due to its long length and relative small wall thickness. During drilling, numerous vibrations in the borehole equipment and, in particular, in the drill string, are generated. In a rotary drill string and bottom hole assembly, torsional, axial and longitudinal or lateral vibrations may occur.

In general, axial vibrations may cause bit bounce, which may damage bit cutters and bearings. Lateral vibrations may be very destructive and may create large shocks as the bottom hole assembly impacts the wall of the borehole. Lateral vibrations may drive the system into backward whirl, creating high-frequency large-magnitude bending moment fluctuations, resulting in high rates of component and connection fatigue. Imbalance in an assembly may cause centrifugally induced bowing of the drill string, which may produce forward whirl and results in one-sided wear of components. Torsional vibrations result, among others, in stick-slip motions or oscillations of the drill string alongside the borehole.

Stick-slip is a phenomenon caused by frictional forces between surfaces of the drill bit and/or the drill string contacting the earth formation surface or the inner wall surface of the borehole. The surfaces of the drill bit and/or the drill string on the one hand and the surfaces of the earth formation and borehole on the other hand, alternatingly may stick to each other or slide over each other, with a corresponding change in the force of friction.

In practice, this friction force shows a non-linear behaviour and, in extreme cases, the friction may become so large that the drill bit, i.e. the bottom hole assembly, temporarily comes to a complete standstill, called the stick mode. During the stick mode, the continuing rotational drive speed or motion of the drive system winds-up the drill string. If the torque build-up in the drill string is large enough to overcome the static friction, the bottom hole assembly starts rotating again, called the slip mode. This, however, may cause a sudden jump or a stepwise increase in the angular acceleration of the movement of the drill bit, inter alia in that the dynamic friction encountered by the drill string and bottom hole assembly is less than the static friction, and may result in excessive wear thereof. Stick and slip modes may follow each other rather quickly in a regular, periodic manner.

When stick-slip occurs, the effectiveness of the drilling process is affected, such that a planned drilling operation may be delayed over as much as a few days, with the risk of penalty fees and the like.

Among others for mitigating the impact of torsional vibrations and resonance in the drill string and the occurrence and impact of stick-slip operation and oscillations, the rotational drive speed of the drive system of the borehole equipment is controlled by a speed controller, the parameters of which are set and tuned to the relevant operational parameters of the borehole equipment. The term "mitigating" has to be construed to include controlling, alleviating, reducing, soften, tempering, relieving, and like meanings, up to and including avoiding torsional vibrations and stick-slip oscillations.

The operational parameters of the borehole equipment, among others, depend on the mechanical properties of the top end drive or surface drive and the string geometry. In practice, the spring geometry parameters need to be provided by the driller by entering, via a keypad of an input/output interface of the speed controller, for example, the inner and outer diameters and length of the drill string tubulars or pipes, and the drill collars of the bottom hole assembly at which the drill bit rests from a spread-sheet or the like. It will be appreciated that, instead of entering the mechanical properties of the borehole equipment itself, one may enter the values of the parameters of the speed controller from a spread-sheet or table or the like, already calculated based on a particular drill string geometry used.

As drilling progresses, the string geometry, i.e. the length and mechanical properties of the tubulars changes due to the lengthening of the drill string and/or changes in the bottom hole assembly. As will be appreciated, each time when extending the drill string, for example by a stand comprising two or three single joints of drill pipe, the dynamics of the borehole equipment change. In practice, this necessitates to retune the parameters of the speed controller approximately every 100 to 200 m of drilling, for example.

Each time determining and manually inputting into the speed controller the operational parameters of the borehole equipment or equivalent values while drilling progresses, is cumbersome to the driller and may introduce errors that may result in reduced Rate Of Penetration, ROP, of the borehole equipment, generally expressed in meters per hour, m/h.

As mentioned above, torsional vibrations and resonance in the drill string of borehole equipment are friction related. Accordingly, external aspects such as the type of earth formation, the type of borehole to be drilled, i.e. vertically, horizontally or askew, the type of mud used, etc., besides the internal mechanical properties of the borehole equipment, all have an influence on the actual operation of the borehole equipment and the occurrence and intensity of the torsional vibrations, drill string resonance frequency and stick-slip operation that may occur during drilling.

In practice, among others for optimally controlling a drilling operation by borehole equipment, both from a technical and an economical point of view, there is a need for automatically modelling borehole equipment by a representative computational model, in particular while drilling a borehole in an earth formation.

SUMMARY

It is an object to provide a method of automatically determining operational parameters of a computational model of borehole equipment for drilling a borehole in an earth formation, among others for providing tuning parameters for use in a speed controller of the borehole equipment.

It is another object to provide a device for automatically determining operational parameters of borehole equipment for drilling a borehole in an earth formation, among others for providing tuning parameters for use in a speed controller of the borehole equipment.

It is a further object to provide an electronic controller for controlling rotational speed of a rotational drive system of borehole equipment for drilling a borehole in an earth formation and arranged for automatically operating with the operational or tuning parameters provided according to the invention.

It is also an object to provide borehole equipment for drilling a borehole in an earth formation operating in accordance with such method and/or equipped with such device for automatically determining operational parameters of borehole equipment or such electronic controller.

In a first aspect there is provided a method of computer controlled determination of operational parameters of a computational model of borehole equipment for drilling a borehole in an earth formation. The borehole equipment comprising a rotational drive system, a drill string having a bottom hole assembly comprising a drill bit and a top end coupled to the rotational drive system, and a speed controller for controlling rotational drive speed of the drive system. The method comprising the steps of:

controlling the drive system such that a torque provided by the drive system while driving the drill string is varied over a time period;

obtaining rotational top end drive speed of the drill string during the time period;

calculating from the varying torque and the obtained rotational top end drive speed an estimated torque-speed transfer function, matching the estimated torque-speed transfer function and a torque-speed transfer function computed from the computational model of the borehole equipment, and determining the operational parameters from the matched estimated torque-speed transfer function and the computed torque-speed transfer function.

The method is based on the insight that the operational parameters of a computational model of the borehole equipment which, among others, depend on the mechanical properties of the top end drive or surface drive, the string geometry and the bottom hole assembly can be approximated by matching a computed transfer function of the drive system, also called the plant, that is a transfer function computed according to a computational model of the dynamics of the borehole equipment comprised by the top drive, drill string and bottom hole assembly, and a transfer function estimated from a varying torque control signal applied to the drive system and the obtained rotational top end drive speed of the drill string in response to this varying torque control signal.

With the method of the invention, while drilling commences, a relevant representative dynamic model of the borehole equipment, in particular of the drill string and bottom hole assembly, can be revealed completely. This provides a very powerful analysis tool for drilling operators as it becomes possible to calculate and simulate from such dynamic computational model the actual operation of the drill bit at the bottom of the borehole during an actual drilling operation. The influence of a change in the drive speed at the top end at the actual operation of the drill bit can be reliably calculated and provided to the drilling operator for analysis, with an aim to constantly or continuously maximize the drilling efficiency, for example.

The method can be performed automatically and autonomously, and the operational parameters thus determined can be provided, for example, as tuning parameters to set the speed controller without the intervention of an operator or other skilled personnel, thereby avoiding mistakes due to manually determining and entering tuning parameters.

As the method can be performed while drilling commences, the speed controller can be automatically, essentially instantaneously, adapted and tuned to the relevant operational parameters of the borehole equipment, among others for mitigating the impact of torsional vibrations and resonance in the drill string, by damping mechanical energy originating from the bottom hole assembly, and the occurrence and impact of stick-slip operation and oscillations.

In an example of the method the torque provided by the drive system is varied by applying a torque control signal having a time-varying signal frequency. That is, the frequency of the signal varies, i.e. increases or decreases, over time. This type of signal is also called a sweep signal.

In an example, wherein the speed controller provides a set torque control signal to the drive system, the torque provided by the drive system is varied by adding or superposing at the set torque control signal a torque control signal having a time-varying signal frequency. However, the varying torque control signal may also be directly applied at the drive system.

For the purpose of the invention, the type of time-varying frequency signal may be selected randomly, for example, provided the spectral content of the signal covers a frequency range of interest inclusive system eigenfrequency. In practice a frequency range of 0-3 Hz is sufficient for obtaining the operational parameters. A so-called white or pink noise signal may be used. An exponentially varying signal frequency over a set time interval, such as an interval of 10 minutes, for example, has been proven to provide accurate parameter values. However, for the purpose of the present invention each type of sweep signal may be applied, such as a linear varying frequency or a randomly varying frequency between a minimum and maximum frequency value, for example.

By increasing the sweep interval, for example up to 60 minutes, the operational parameter values determined will be less affected by noise produced during the drilling operation. However, as the drilling conditions may vary relatively quickly, in practice, a sweep duration of 60 minutes may be too long for determining the tuning parameters.

It has been found that by applying a multi-tone sweep signal, i.e. a torque control signal composed as a superposition of a plurality of signals over a set time interval, such to comprise a relatively slow frequency varying signal and a relatively fast frequency varying signal, for example, accurate results can be obtained within a limited measurement time interval of, for example, 10 minutes.

Matching of the transfer functions, in an example of the invention, comprises matching of the estimated and computed transfer function of the drive system according to a computational model of the dynamics of the borehole equipment or equivalent torque-speed transfer functions in the spectral domain. That is, the relevant parameters of the selected computational model of the dynamic part of the borehole equipment are adapted such that the amplitude and phase curves of the respective transfer functions match, i.e. cover each other as best as possible. As will be appreciated by those skilled in the art, matching can be performed by a suitable software routine programmed in commercially available calculation and simulation tools such as MATLAB™, for example.

The mechanical damping that the drill string encounters, i.e. damping as result of the drilling mud and engagement of the drill string and the wall of the borehole, can be effectively determined from the matched estimated torque-speed transfer function and the computed torque-speed transfer function.

The top end drive speed of the drill string can be obtained directly by measuring the rotational speed of the shaft of the drive system motor by a speed sensor, for example, or in an indirect sensorless manner from the voltage and current supplied to an electric system drive motor, for example.

The controlling, obtaining, calculating and matching steps of the method according to the invention can be periodically repeated at set intervals, for example. The operational parameters values should be determined if the input and output signals, i.e. the varying torque and top end drive speed, respectively, reach a predetermined degree of coherence. That is if causality between the input and output signals can be shown. This to reduce errors due to artifacts and noise in the measurement results caused by anomalies that may occur during drilling.

The degree of coherency may be determined at frequency values at which the estimated and equivalent transfer functions are obtained.

To avoid disturbance of an actual drilling operation by the method according to the invention, the torque imposed by the drive system is varied over the time period to provide a limited variation of the top end drive speed of the drill string, for example a variation less than 10-15% of a set rotational top end drive speed of the drill string.

As the quality factor of the drill string during off-bottom operation is about a factor 10 or more higher than during on-bottom operation, caused by a reduced damping during off-bottom operation, very accurate results are obtained when applying the controlling, obtaining, calculating and matching steps of the invention while the borehole equipment is operated with the bottom hole assembly off-bottom. This can be performed, for example, directly after the drill string length has been extended by a stand.

The tuning parameters of the speed controller are determined at least each time after part of the drill string has been modified and may be automatically periodically determined while drilling commences.

The computational model is at least one of a state-space model, an equivalent electric circuit model, an equivalent mechanical torsional spring-inertia model, a segmented model, a continuous-time model, a discrete-time model, a frequency domain model, and a wave propagation model. The computational model may include representation of an actual earth formation in which the borehole is drilled.

The method according to the invention may be performed by computer or processing equipment located at a drilling site and/or in a computer system remote from the borehole equipment.

In a second aspect there is provided a device for computer controlled determination of operational parameters of a computational model of borehole equipment for drilling a borehole in an earth formation, the borehole equipment comprising a rotational drive system, a drill string having a bottom hole assembly comprising a drill bit and a top end coupled to the rotational drive system, and a speed controller for controlling rotational drive speed of the drive system, the device comprising a computer controlled operational parameter control system arranged for:

- controlling the drive system such that a torque provided by the drive system while driving the drill string is varied over a time period;
- obtaining the rotational top end drive speed of the drill string during the time period;
- calculating from the varying torque and measured rotational top end drive speed an estimated torque-speed transfer function,
- matching the estimated torque-speed transfer function and a torque-speed transfer function computed from a computational model of the borehole equipment, and
- determining the operational parameters from the matched estimated torque-speed transfer function and the computed torque-speed transfer function.

In a further embodiment, the operational parameter control system is arranged for determining the operational parameters in accordance with the method of any of the examples disclosed above.

In an embodiment, the operational parameter control system operatively connects to the speed controller and is arranged for providing tuning parameters to the speed controller from determined operational parameters.

In another embodiment the operational parameter control system comprises a signal generator unit arranged for generating a time-varying frequency signal, i.e. a sweep signal, for varying the torque provided by the drive system over a time period. Generators of this type are known to the skilled person and, for the purpose of the present invention, need no further elaboration.

In a third aspect, there is provided an electronic controller for controlling rotational drive speed of a rotational drive system of borehole equipment for drilling a borehole in an earth formation, the borehole equipment comprising a drill string having a bottom hole assembly comprising a drill bit and a top end coupled to the rotational drive system, and a speed controller for controlling rotational drive speed of the drive system, the electronic controller comprising a data input for receiving data for providing a time-varying frequency torque control signal and a data input/output for receiving tuning parameters obtained from operational parameters determined in accordance with the method disclosed above.

In an embodiment of the electronic controller a signal generator unit is provided for providing the time-varying frequency torque control signal.

In a fourth aspect of the in invention borehole equipment for drilling a borehole in an earth formation is provided, the borehole equipment comprising a rotational drive system, a drill string having a bottom hole assembly comprising a drill bit and a top end coupled to the rotational drive system, a speed controller for controlling rotational drive speed of the drive system, and a device for computer controlled determination of operational parameters operatively connected to the speed controller for providing tuning parameters to the speed controller, as disclosed above.

Although the examples presented refer to specific computer software using MATLAB™ for computing the transfer function of a selected computation model and for matching the transfer functions, the method, device, electronic controller and borehole equipment disclosed in the summary part of the present application are not to be construed as limited to this type of computer software program. To the contrary, the invention may be applied with any commercially available computer program for computing and matching transfer functions of a dynamic system, as well as proprietary software programs written, for example, in C, C+ or C++.

DETAILED DESCRIPTION

Figure 1:
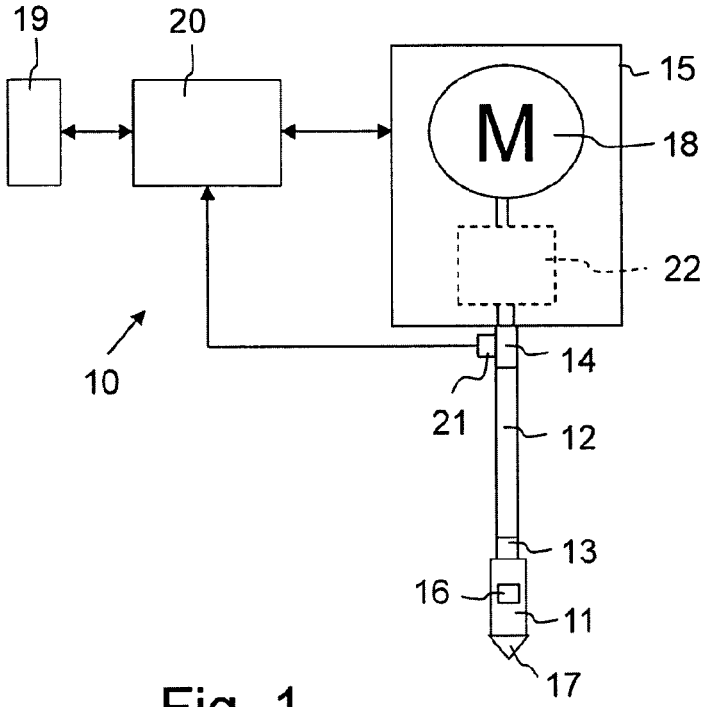
FIG. 1 is a very schematic representation of prior art borehole equipment for drilling a borehole in an earth formation.

FIG. 1 shows, in a very schematic manner, a typical borehole equipment 10 of a drilling rig for drilling a borehole in an earth formation. A cutting tool or drill bit 17 connects to a bottom hole assembly, BHA, 11 at a bottom end 13 of a drill string 12. At a top end 14 thereof, the drill string 12 is coupled to a rotational drive system 15, also called top drive or rotary table, which, in turn, is fixed to the surface of an earth formation in which a borehole is to be drilled by a derrick or chassis of the drilling rig (not shown).

The drill string 12 comprises lengths of hollow tubulars or drill pipes, threaded together end by end. A typical drill string is several kilometers long, such as 0-10 km, and the drill pipe may have an outer diameter of about 100-300 mm and a wall thickness of about 10-50 mm. The BHA 11 consists of heavier pipes that may have an outer diameter of about 250-500 mm and a wall thickness of about 100 mm, for example. The length of the BHA is typically in the range of 100-300 m. The drill string 12 is very slender compared to its length.

Although not shown, in an actual drilling operation, drilling fluid is pumped through the drill pipes of the drill string 12 towards the drill bit 17 for cooling and lubrication of the drill bit 17. Cuttings from the drilling operation are returned back up to the surface by the drilling fluid flowing through an annulus formed between the outer circumference of the drill string 12 and the borehole (not shown).

The bottom hole assembly 11 comprises several sensors and transmitters 16 and a directional tool (not shown) for directing the bottom hole assembly 11 to drill a borehole in a certain direction in the earth formation, such as vertical, horizontal or deviated at an angle and, of course, combinations thereof.

Drilling data and information are displayed at a console 19 comprising a display or other data output device (not shown) and an input device such as a keyboard, touch screen and the like (not shown) by which, through an intermediate speed controller 20, a driller may control rotational speed of the drive system 15 by inputting tuning parameters for the speed controller 20 and/or setting a torque limit for the drive system 15, for controlling the rotational speed of the drill bit 17.

The drive system 15 comprises a rotary drive system motor 18 to rotate the drill string 12, the BHA 11 and thereby the drill bit 17. Between the drive system motor 18 and the drill string 12 optionally a gearbox 22 may connect, having a particular gear reduction or a range of gear reductions.

Nowadays the drive system motor 18 generally is an electric motor, for example an 800 kW induction motor powered by a power converter. However, the present invention is equally applicable with a synchronous machine, a brushed DC machine, diesel engine, a hydraulic motor, or the like. The rotational speed of the drill string 12 may be measured at its top end 14 by a speed indicator or speed sensor 21, the measurement signal of which is input to the speed controller 20. However, in the case of an electric drive system motor, the top end drive speed of the drill string may be obtained by the speed controller 20, for example, in a sensorless manner from the voltage and current supplied to the electric system drive motor 18.

In use, at its top end 14, the drill string 12 can be pulled upwards by hoisting machinery, also called draw-works (not shown). On the bottom end 13, when on-bottom, the BHA 11 is resting at or touches the earth formation by the drill bit 17. This contrary to an off-bottom BHA 11 position, in which the drill bit 17 does not touch the earth formation at the bottom of the borehole. The slender drill pipes of the drill string 12 are constantly in tension, while the thick-walled lower part of the BHA 11 is partly in compression. The tension in the drill pipes avoids buckling of the drill pipe section. The torsional rigidity of the drill pipe section is, however, relatively small due to its slender construction.

In practice, several types of speed controllers 20 have been developed and used, the control operation of which complies to a well-known PI controller, operable for providing a type of proportional action, P, and a type of integral action, I. In the case of an electric drive system motor 18, for example, the speed controller 20 may be arranged to operate on a feedback from any or all of measuring variables such as the drive motor current, the rotational speed of the drive motor, and fluctuations in the drive motor current and rotational speed. This, for example, to control the energy flow in the drive system 15 by controlling any or both of these variables and to measure the rotational speed exerted by the drive motor 18 at the top end 14 of the drill string 12.

Although the drive system 15 may operate in different modes, such as a so-called spinning mode and make-up mode, the present invention is directed to the drill-mode, during which the driller aims to effectively grind or cut away material from an earth formation or geological formation by pushing and turning the drill bit 17 and flushing the borehole with drilling fluid or mud.

The dynamic system comprised by the top drive, drill string and bottom hole assembly, can be represented by an or a combination of different model representations, among which, a state-space model, an equivalent electric circuit model, an equivalent mechanical torsional spring-inertia model, a segmented model, a continuous-time model, a discrete-time model, a frequency domain model, and wave propagation models, such as mechanical and electrical type transmission line models.

Figure 2:
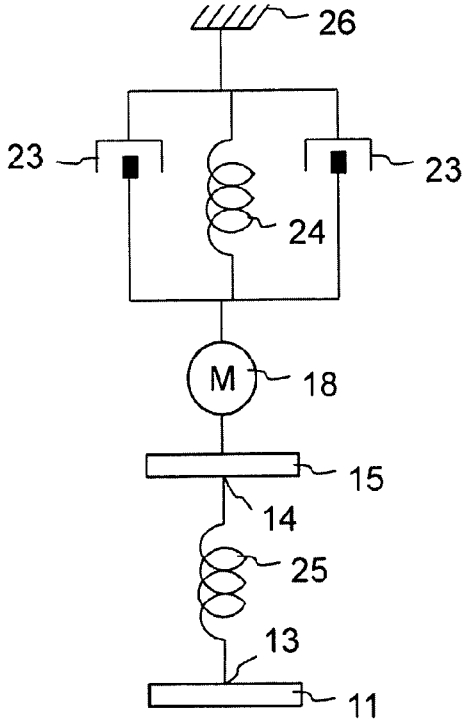
FIG. 2 shows a simplified mechanical model of the borehole equipment shown in FIG. 1.

Referring to FIG. 2, for the purpose of explaining the invention, there is shown a simplified mechanical model representation of the borehole equipment 10 of FIG. 1. The drill string 12 is modeled by a torsion spring 25. The speed controller 20 is modeled by a torsion spring 24 and a rotational damper 23, operating in concert to provide a damping action for damping rotational vibrations of the drill string 12 by absorbing rotational vibration energy thereof. The derrick or chassis of the drilling rig is represented by reference numeral 26. This lumped mechanical model has to be proven to be sufficiently accurate for a majority of applications.

The BHA 11 has an inertia $J_b$ [kgm$^2$] and the drill string 12, i.e. the equivalent torsion spring 25, has a torsion stiffness $K_s$ [Nm/rad]. The drive system 15 has an inertia $J_d$ [kgm$^2$]. The torsion spring 24 of the speed controller 20 has a torsion stiffness $K_f$ [Nm/rad] and the damper 23 has a damping $C_f$ [Nms/rad]. For the purpose of the invention, the bottom hole inertia $J_b$, the torsion stiffness $K_s$ of the drill string, the drive system inertia $J_d$, the torsion stiffness $K_f$ and damping $C_f$ of the speed controller form the operational parameters of the lumped mechanical model of the borehole equipment shown in FIG. 2.

In operation, the speed controller 20 is operated to enlarge drive mobility of the borehole equipment by controlling the top drive resonance frequency, which essentially is determined by the torsion stiffness $K_f$ of the speed controller 20 and the inertia $J_d$ of the drive system 15, being close or equal to the resonance frequency of the drill string 12 and the bottom hole assembly 11. This, to dampen drill string resonances by the damping term $C_f$ of the speed controller 20. That is, $K_f$ and $J_d$ of the drive system side have to be properly matched to the $K_s$ and $J_b$ at the drill string side by tuning the speed controller 20 to the resonance frequency of the drill string with a proper damping to mitigate stick slip. In the example of FIG. 2, $K_s$, $J_b$ and $J_d$ are the tuning parameters for setting the parameters $K_f$ and $C_f$ of the speed controller 20.

In practice, the speed controller 20 operates as PI controller, having a proportional action, P, and an integral action, I, or as PII controller, having a double integral action, for example.

In the mechanical model representation of FIG. 2, losses in the drive system 15 and the drill string 12, due to the friction forces and the like, are not explicitly modeled.

Figure 3:
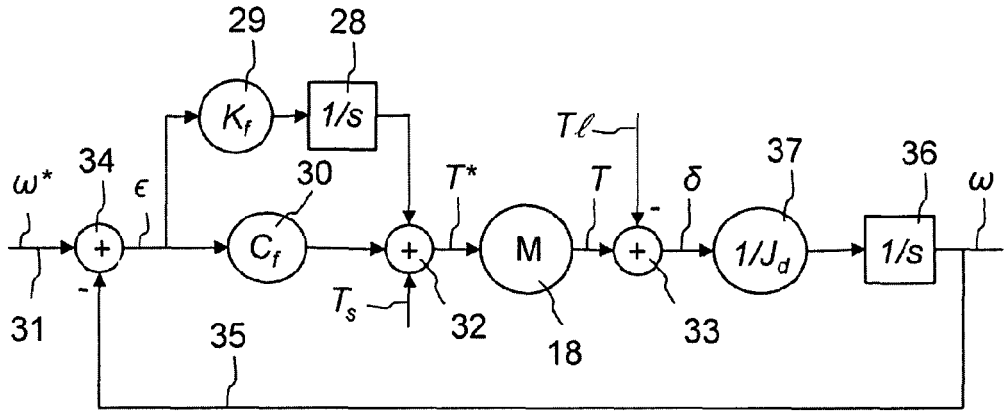
FIG. 3 shows a system model of borehole equipment in accordance with FIG. 2 for varying a torque applied by the drive system in accordance with the invention.

FIG. 3 shows, for the purpose of explaining the invention, by way of example, a computational spectral domain model representation of the mechanical system model representation of the borehole equipment of FIG. 2, for calculating a torque-speed transfer function of the torque applied by the drive system for rotating the drill string 12 and BHA 11, and the rotational drive speed of the drill string 12 at the top end 14 thereof. The spectral domain is represented by the complex argument or operator s, following the well-known Laplace transform theory. The gear box 22 is assumed not to be present.

In the system model of FIG. 3, reference numerals 32, 33, 34 denote summation operations. Reference numerals 29 and 30 represent the parameters $K_f$ and $C_f$ of the speed controller 20, respectively. The action 28 of the equivalent torsion spring 24 of the speed controller 20 in the spectral domain is modeled by the Laplace operation 1/s.

The speed controller 20 operates, while drilling, to generate a torque control signal for controlling the drive system motor 18 to provide a torque such that the top end 14 of the drill string 12 rotates at a rotational speed set by a speed signal $\omega^*$ at an input 31 of the speed controller 20. The signal $T^*$ represents a torque control signal at the input of the drive system motor 18. The actual torque provided by the drive system motor 18 is termed T [Nm].

In the spectral domain, the action of the drive system 15, also called the plant, is modeled by the inverse 37 of its inertia $J_d$, and the Laplace operation 36. i.e. 1/s.

The signal $\epsilon$ representing the difference between the speed signal $\omega$ representative of the actual rotational speed [rad/sec] at the top end 14 of the drill string 12, for example measured by the speed sensor 21 at the top end 14 of the drill string 12, and the input speed signal ω* representative of the set rotational speed [rad/sec], formed by the summation operation 34, i.e. $\epsilon=\omega^*-\omega$, is fed to the speed controller 20 represented by the respective parameters $K_f$ 29 and $C_f$ 30 and the Laplace operation 28.

The signal δ represents a difference between the torque T applied by the drive system motor 18 and the actual load torque Tl at the BHA 11, formed by the summation operation 33, i.e. δ=T−Tl.

In the system model shown in FIG. 3, in accordance with the invention, the torque T applied by the drive system motor 18 for rotating the drill string 12 can be varied by varying the torque control signal T* at the drive system motor 18, by applying a variable torque control signal $T_s$ that is summed or superposed by the summation operation 32 at the torque control signal provided by the speed controller 20 in accordance with an actual drilling operation.

Figure 4:
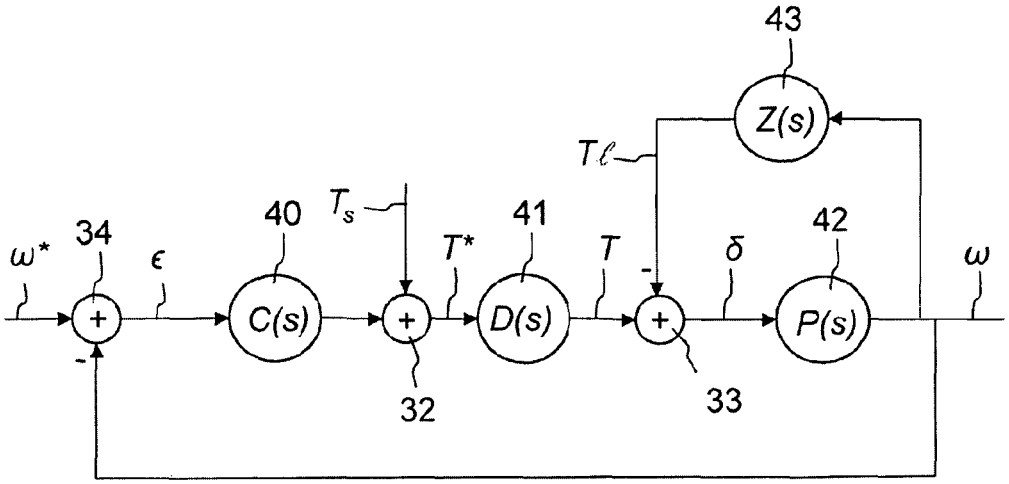
FIG. 4 shows the system model of FIG. 3 in a further simplified version for calculation purposes.

To ease calculations and to enhance the understanding thereof, reference is made to the system model of the borehole equipment shown in FIG. 4, which is a simplified representation of the system model of FIG. 3.

In FIG. 4, reference numeral 40 represents the transfer function C(s) of the speed controller 20. Reference numeral 41 represents the transfer function D(s) of the drive system motor 18. Reference numeral 42 represent the plant transfer function P(s) of the top drive 15, and reference numeral 43 represents the transfer function Z(s) of the drill string and BHA. Hereinafter written in short notice as C, D, P, Z, respectively.

The drive speed ω at the top end 14 of the drill string 12 can be described by:

$$\omega = \underbrace{\frac{CDP'}{1+CDP'}}_{F(s)}\omega + \underbrace{\frac{DP'}{1+CDP'}}_{H(s)}T_s \underbrace{\frac{P'}{1+CDP'}}_{M(s)}T\ell \tag{1}$$

and $$P' = \frac{P}{1+PZ} \tag{2}$$

wherein:

F(s)=reference tracking transfer function, hereinafter written as F

H(s)=variable torque transfer function, hereinafter written as H

M(s)=disturbance reaction or mobility function, hereinafter written as M.

That is:

$$F = \frac{CDP'}{1+CDP'} \tag{3}$$

$$H = \frac{DP'}{1+CDP'} \tag{4}$$

$$M = \frac{-P'}{1+CDP'} \tag{5}$$

Accordingly, equation (4) can be rewritten as:

$$\omega=F\omega^*+HT_s-MTl \tag{6}$$

From equation (3) it follows that the reference tracking transfer function F approaches unity as long as |CDP'|>>1 which is valid for relatively low frequencies for which |C| appears to be relatively large. The notation |x| refers to the absolute value or modulus of x.

For an idealized or perfect drive system motor, the motor transfer function D is close to unity for all frequencies of interest, that is D≈1. In practice, however, D often includes some delay, for example 10 ms or more, and behaves like a first order low pass filter. The cross-over frequency of D can be as low as 5 Hz.

Assuming a perfect drive system motor transfer function, i.e. D=1, from equations (4) and (5) one can see that M=−H. For |CDP'|>>1 and D=1, from equations (4) and (5) it follows that the mobility function M and the variable torque transfer function H approximate the inverse of the transfer function of the speed controller, i.e. M≈1/C and H≈1/C.

For |CDP'|<<1 and D=1, from equations (4) and (5) it follows that the mobility function M and the variable torque transfer function H both approximate the transfer function P', that is M≈−P' and H≈P'.

Assuming an idealized speed controller, the transfer function C thereof represented by the parameters $K_f$ 29 and $C_f$ 30, and the integrating operation 28 reads (see FIG. 3), reads:

$$C = C_f + \frac{K_f}{s} \tag{7}$$

For an unloaded top drive, i.e. no drill string attached, Z equals zero, such that from equation (2) it follows that the transfer function $P_{unloaded}$ of the plant model, i.e. speed in, torque out, equals the transfer function P' and can be approximated by a pure inertia (see FIG. 3):

$$P_{unloaded} = \frac{\omega}{T} = \frac{1}{sJ_d} \tag{8}$$

For a loaded top drive, i.e. when the drill string is attached to the drive system, wherein the transfer function Z of the drill string and BHA is part of the plant, the case is quite different. The loaded plant transfer function $P_{loaded}$ equals:

$$P_{loaded} = \frac{\omega}{T} = \frac{\frac{1}{sJ_d}}{1+\frac{Z}{sJ_d}} = \frac{1}{sJ_d+Z} \tag{9}$$

Assuming an idealized drill string 12, consisting of torsion stiffness $K_s$, and an idealized BHA 11, having inertia $J_b$, the transfer function of the drill string and BHA, in the spectral domain, is represented by the action of the equivalent torsion spring 25 of the drill string 12, modeled by the value of the torsion stiffness $K_s$ and the Laplace operation 1/s, i.e. $K_s/s$, and the inertia $J_b$ of the BHA 11 with the Laplace operation 1/s, i.e. $1/(sJ_b)$.

From this model, the following transfer function Z of the drill string and BHA results:

$$Z = \frac{T\ell}{\omega} = \frac{sJ_bK_s}{s^2J_b+K_s} \tag{10}$$

The transfer function Z of the drill string shows a resonance behavior for those frequencies at which the denominator of equation (9) equals zero. With s=jω, from equation (9) the resonance frequency $\omega_0$ equals:

$$\omega_0 = \sqrt{\frac{K_s}{J_b}} \tag{11}$$

For lower frequencies, i.e. when $s \ll j\omega_0$, equation (10) may be written as:

$$Z \approx \frac{1}{sJ_b} \tag{12}$$

That is, at lower frequencies, the transfer function Z of the drill string 12 and the BHA 11 is essentially determined by the inertia $J_b$ of the BHA 11.

For frequencies well above the resonance frequency, i.e. when $s \gg j\omega_0$, equation (9) may be written as:

$$Z \approx sK_s \tag{13}$$

That is, for higher frequencies, the transfer function Z of the drill string 12 and the BHA 11 is essentially determined by the torsion stiffness $K_s$ of the drill string 12.

The idealized loaded plant transfer function $P_{loaded}$, i.e. ignoring any friction components and the like, is calculated by substituting equation (10) in equation (9), yielding:

$$P_{loaded} = \frac{\omega}{T} = \frac{s^2 J_b + K_s}{s^3 J_b J_d + sK_s(J_b + J_d)} \tag{14}$$

From equation (14) some interesting observations can be made. Below resonance, i.e. $s \ll j\,\omega_0$, under load conditions, the plant transfer function approximates:

$$P_{loaded} \approx \frac{1}{s(J_b + J_d)} \tag{15}$$

equivalent to a single inertia comprised of the sum of $J_b$ and $J_d$. At the resonance frequency, i.e. $s=j\,\omega_0$, the plant transfer function $P_{loaded}=0$.

As disclosed above, for $|CDP| \ll 1$ and D=1, from equation (4) it follows that the variable torque transfer function H, i.e.

$$H = \frac{\omega}{T_s} \tag{16}$$

approximates the plant transfer function P, i.e. H≈P.

From the above it will be appreciated that the operational parameters of the dynamic part of the borehole equipment, i.e. the torsion stiffness $K_s$ of the drill string, the inertia $J_b$ of the bottom hole assembly, and the inertia $J_d$ of the drive system 15 can be readily found by matching the plant transfer function estimated from system measurements with a computed transfer function of the dynamic part of the borehole equipment comprised by the top drive, drill string and BHA, such as the plant transfer function equation (14) above.

For setting or tuning the speed controller 20 to provide an optimum damping $C_f$ at resonance of the drill string, for example, the torsion stiffness $K_f$ and the drive system inertia $J_d$ have to be tuned to the drill string torsion stiffness $K_s$ and the BHA inertia $J_b$. Accordingly, the operational parameters $K_s$ and $J_b$ determined from the matching operation can be used as tuning parameters for tuning the speed controller 20.

Figure 5:
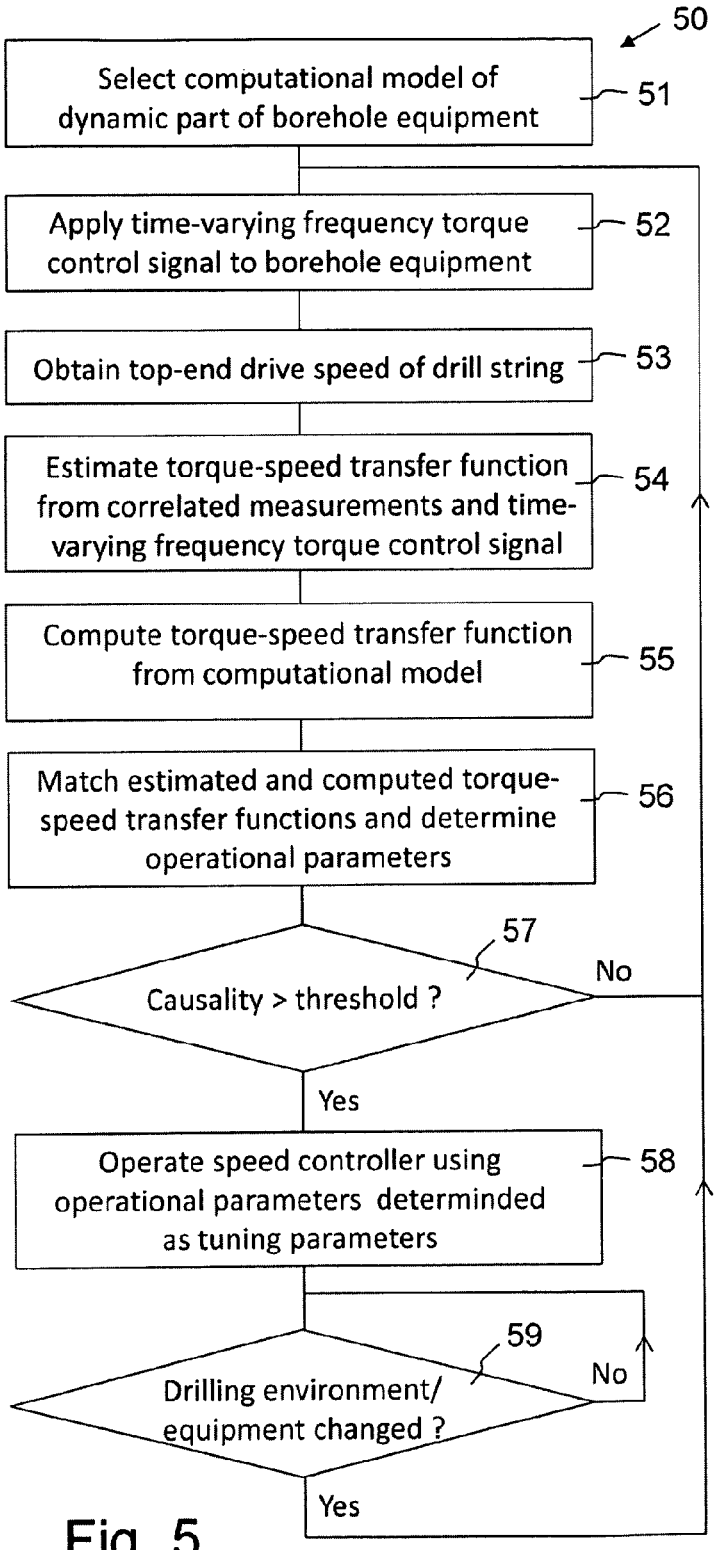
FIG. 5 shows a simplified flow chart diagram for automatically determining the operational parameters of a computational model of borehole equipment and operating a speed control with tuning parameters obtained from such operational parameters in accordance with the invention.

FIG. 5 illustrates, by a simplified flow chart 50, the steps to be processed by a digital processor, computer or other data processing device, for approximating the operational parameters of borehole equipment, for example for setting the speed controller for controlling a drive system of the borehole equipment, from applying a varying torque control signal $T_s$ at the drive system and the retrieved rotational drive speed ω of the top end of the drill string, in accordance with an example of the invention with reference to FIGS. 1, 2, 3 and 4.

The direction of flow is assumed from the top to the bottom of the sheet. Other directions are indicated by a respective arrow.

As a first step, a suitable computational model representing the dynamic part of borehole equipment 10 comprised by the drive system or top drive 15, drill string 12 and BHA 11 is selected, i.e. block 51 "Select computational model of dynamic part of borehole equipment".

The computational model selected may be any suitable model for representing actual borehole equipment, such as a state-space model, an equivalent electric circuit model, an equivalent mechanical torsional spring-inertia model, a segmented model, a continuous-time model, a discrete-time model, a frequency domain model, and a wave propagation model, for example. In general this computational model is selected once.

Next, as shown by block 52, "Apply time-varying frequency torque control signal to borehole equipment", during a particular measurement time interval or time period, such as a time interval in the order of a plurality of seconds, for example, a torque control signal $T_s$ is applied to the drive system 15, i.e. the drive system motor 18, of the actual borehole equipment 10. The signal frequency of the torque control signal $T_s$ varies in time to vary the torque T delivered by the drive system 15. The signal frequency of the torque control signal $T_s$ does not necessarily have to vary in time according to a particular function or variation. The amplitude of the torque control signal $T_s$, i.e. the actual torque variation induced thereby, should be selected such that a certain minimum torque variation is imposed at the top end 14 of the drill string 12, for example a minimum of 1 kNm. However, the actual amount of this minimum may vary dependent on the actual borehole equipment and drilling application used. In practical drilling operations, torque variations in the order of a fraction, i.e. a small percentage, of a set drilling torque should be imposed to arrive at useful measurement results. The amplitude of the torque control signal $T_s$ applied may be constant or may vary over the measurement interval.

While a time-varying frequency torque control signal $T_s$ is applied, i.e. a torque control signal having a time-varying signal frequency, the rotational drive speed ω of the top end 14 of the drill string 12 is obtained and registered, i.e. correlated, as a of function $T_s$ during the measurement time interval or measurement time period, i.e. block 53 "Obtain top end drive speed of drill string". The rotational top end drive speed of the drill string 12 is measured, for example, at its top end 14 by a speed indicator or speed sensor 21, as shown in FIG. 1. However, any other suitable speed measurement technique or equipment may be used, such as sensorless estimating the top end drive speed from the voltage and current fed to an electric drive system motor 18.

From the measurement results thus obtained, as illustrated by block 54, "Estimate torque-speed transfer function from the correlated measurements and time-varying frequency torque signal", a torque-speed transfer function of the dynamic part of the borehole equipment is estimated, that is $\omega/T_s$. Such an estimation may comprise, for example, a graphical representation of the amplitude of the estimated torque-speed transfer function, expressed in rad/Nms, and the phase thereof, expressed in deg, both against the or part of the frequency range, expressed in Hz, of the time-varying frequency torque control signal $T_s$.

Following the computational model selected in block 51, a torque-speed transfer function of the dynamic part of the borehole equipment is computed, i.e. block 55, "Compute torque-speed transfer function from computational model". This computation may comprise, for example, a graphical representation of the amplitude of the computed torque-speed transfer function and the phase thereof, both against the or part of the frequency range of the time-varying frequency torque control signal $T_s$ actually applied.

The thus obtained estimated and computed torque-speed transfer functions are then matched, i.e. block 56, "Matching estimated and computed torque-speed transfer functions and determine operational parameters". This matching may comprise fitting of the graphical representations of the amplitude and phase of the estimated and computed speed-torque transfer functions over a frequency range of interest. For example by selecting the torsion stiffness $K_s$ of the drill string, the inertia $J_b$ of the bottom hole assembly and the inertia $J_d$ of the drive system such that at each measurement point the distance in the complex plane between the estimated and computed torque-speed transfer function is minimized.

From the spectral domain system model representation of the mechanical system computational model representation of the borehole equipment of FIG. 2, for example, from equation (14) it follows that the operational parameters of the computational model of the borehole equipment, i.e. the torsion stiffness $K_s$ of the drill string, the inertia $J_b$ of the bottom hole assembly, and the inertia $J_d$ of the drive system can be readily found by matching the torque-speed plant transfer function estimated from the measurements of the top end drive speed of the drill string with the computed torque-speed transfer function according to the computational model of the dynamic part of the borehole equipment.

In practice, computer software applications, programs and tools for estimating torque-speed transfer functions, for computing model transfer functions and for matching transfer functions are commercially available and well known to the person skilled in the art. MATLAB™ is an example of such commercially available computer software programs for analyzing the spectral behavior of a dynamic plant system. However, the invention is not to be construed as limited to this type of model and computer software programs, nor to estimates and computations in graphical representations or frequency or spectral domain analysis.

Those skilled in the art will appreciated that a change in the top end drive speed may result from several other drilling events, apart from the applied torque variation. Consequently, as a quality measure, it is checked whether the obtained top end drive speed signal is a causal result, i.e. the effect, of the applied time-varying frequency torque signal, i.e. the event. Causality is the relationship between a first event (the cause) and a second event (the effect), where the second event is understood as a consequence of the first event.

In an embodiment, for example, it is checked whether a causality measure obtained is above a set threshold, i.e. decision block 57, "Causality>threshold ?". In the affirmative, i.e. decision block 57, outcome "Yes", the thus obtained operational parameters are sufficient accurate and may be used, for example, for operating the speed controller 20 of the borehole equipment by setting its parameters, i.e. $K_f$ and $C_f$ as shown in FIG. 2, using the thus obtained torsion stiffness $K_s$ of the drill string, the inertia $J_b$ of the bottom hole assembly, and the inertia $J_d$ of the drive system, i.e. block 58 "Operate speed controller using tuning parameters determined as tuning parameters".

If the degree of causality is insufficient given a set causality threshold, for example, i.e. decision block 57, outcome "No", the process according to the steps illustrated by blocks 51-56 may be repeated. A causality measure may be obtained, for example, from a coherence measure.

Coherence in the spectral domain is commonly used to estimate the power transfer between input and output of a transfer system. The coherence $R_{xy}$ (sometimes called magnitude-squared coherence) between two values or signals x and y is a real-valued function that is defined as:

$$R_{xy} = \frac{|G_{xy}|^2}{G_{xx}G_{yy}} \tag{17}$$

where $G_{xy}$ is the cross-spectral density between x and y, $G_{xx}$ and $G_{yy}$ are the auto-spectral densities of x and y, respectively, and the magnitude of the spectral density is denoted as $|G|$.

If $R_{xy}$ is less than one but greater than zero it is an indication that either: noise is entering the measurements or that y is producing output due to input x as well as other inputs. If the coherence is equal to zero, it is an indication that x and y are completely unrelated. Accordingly, the coherence between the perceived rotational top end drive speed signal and the applied time-varying frequency torque signal, calculated at a plurality of selected frequency values, may be used to determine causality between the signals in accordance with the invention.

It has been observed that in practice, when an actual speed controller operates the drive system at its upper operational torque limit, the dynamic behaviour of the speed controller may not be accurately modelled anymore as a linear operating system. Among others due to so-called anti-wind up measures or techniques implemented in the speed controller and actual system saturation effects, i.e. clipping effects. In such a case, the coherence will be low too. As a remedy, a corrected time-varying frequency torque signal may be derived by subtracting, from the output of the actual non-linear system inclusive the actual time-varying frequency torque signal, the output of a simulated ideal linear speed controller. As long as the actual system operates within its operational boundaries, the corrected time-varying frequency torque signal equals the actual time-varying frequency torque signal. In the event of clipping, the corrected time-varying speed signal continues to satisfy the assumption of a linear operating speed controller.

It is noted that, for the purpose of the present invention, instead of $R_{xy}$ calculated according to equation (17) above, other calculations may be used for determining a degree of coherence between two values or signals, as known to those skilled in the art.

During drilling, the drill string 12 will be extended by more drill pipes and the angular direction of the drill bit and material properties of the earth formation encountered may change.

With reference to the flow chart of FIG. 5, when in the course of a drilling operation the length of the drill string 12 is increased, for example, or if the drilling environment significantly changes, decision block 59, "Drilling environment/equipment changed ?", outcome "Yes", the process as illustrated by blocks 52-58 is repeated for automatically determining operational parameters of the borehole equipment and automatically operating the speed controller with a set of tuning parameters adapted to respective operational parameters after changes in the drilling operation. Otherwise, decision block 59 result "No", the drilling operation may continue while the tuning parameters of the speed controller remain unchanged. In practice, the autotuning process may have to be repeated by each increase of a drill pipe length. Such a change in the drilling environment may be detected automatically, for example, by monitoring whether the top end drive speed approximates zero.

It will be appreciated that the inertia $J_d$ of the drive system 15 and the inertia $J_b$ of the bottom hole assembly 11 will not have to be established anew each time the drill string is extended. The inertia $J_d$ of the drive system may also be known beforehand from data provided by the operator of the borehole equipment, for example, such to considerable ease the matching process. In such a case, a comparison of the value of $J_d$ determined in accordance with the invention and a known value of $J_d$ may serve as a check for the accuracy of the operational parameters determined in accordance with the invention.

In an embodiment of the invention, decision block 59 may be further arranged to repeat the process of determining the operational parameters of the borehole equipment and the autotuning process according to blocks 52-58 during drilling after a set repeat time interval, for example every 10 min of operation, decision block 59 would then read, for example, "Drilling environment/equipment changed/repeat time interval expired". This, as a diagnostic tool during drilling.

The method of automatically determining the tuning parameters for the speed controller in an example of the invention may also be performed whilst the bottom hole assembly is off-bottom, that is when the drill bit does not touch the earth formation at the bottom of the borehole. For example, just before a drilling operation commences after the drill string length has been extended. It will be appreciated that in such a case the quality factor or Q factor of the dynamic part of the plant system is much higher than when the bottom hole assembly is on-bottom, i.e. when the drill touches the earth formation at the bottom of the borehole, which translates into a much higher damping term than when off-bottom. The off-bottom process results show a better coherence than the on-bottom process results.

The manner in which the parameters of the speed controller 20 are set, i.e. tuned to the operational parameters obtained, depends on a particular drilling operation and particular borehole equipment and the object to be achieved such as, for example, mitigating stick-slip oscillations using commercially available control software, such as known as SOFT TORQUE®, disclosed by U.S. Pat. No. 5,117,926.

As an alternative to the mechanical computational model of borehole equipment discussed above, FIG. 6 shows a schematic electrical equivalent circuit diagram comprising electrical elements forming a first order computational model of the borehole equipment of FIG. 2 in accordance with the invention.

Figure 6:
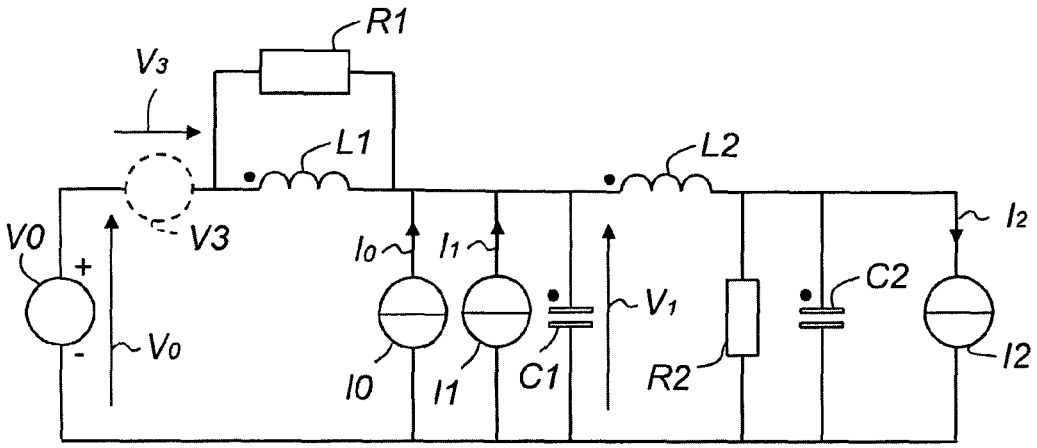
FIG. 6 is a schematic electrical equivalent circuit diagram forming a computational model for calculating a torque-speed transfer function of the dynamics of the borehole equipment of FIG. 1 in accordance with the invention.

In the computational model of FIG. 6 the drill string 12 is modelled by an inductor L2 with an inductance value $L_2=1/K_s$ [H]. The inertia of the drive system 15 is modelled by a capacitor C1 with a capacitance value $C_1=J_d$ [F]. The bottom hole assembly is modelled by a capacitor C2 with a capacitance value $C_2=J_b$ [F], wherein $J_b$ is the inertia of the bottom hole assembly 11. Damping of the rotation of the drill string 12 and bottom hole assembly 11, amongst others caused by drilling fluid or mud pumped downwards, through the drill pipes of the drill string 12 towards the drill bit 17 and back upwards, is modeled by a resistor R2 having a resistance value $R_2$ [Ω] and connected in parallel with capacitor C2. In the model of FIG. 6 the inductor L2 series connects the capacitors C1 and C2.

In the computational model of the borehole equipment according to FIG. 6, with reference to FIG. 3, the speed controller 20 is modelled as a conventional PI controller. The set speed signal ω* is represented by a DC voltage source V0, having a voltage value $V_0=\omega^*$[V], series connected to the capacitor C1 and the inductor L2 by an intermediate parallel inductor/resistor circuit, i.e. inductor L1 having an inductance value $L_1=1/K_f$ [H] representing the integral, I, action equivalent to the torsion stiffness $K_f$ and resistor R1 having a resistance value $R_1$ [Ω] representing the proportional, 1/P, action equivalent to a the damping $C_f$ provided by the speed controller 20, i.e. $R_1 \approx 1/C_f$.

In the model or equivalent circuit diagram of FIG. 6 the actual drive speed ω at the top end 14 of the drill string 12 is represented by the voltage $V_1$ across capacitor C1. The load torque Tl exerted on the drill bit 17 is modelled by a current source I2 and current $I_2$ [A], parallel connected to the capacitor C2. The torque provided by the drive system 15 is modelled by a current source I1 and current $I_1$ [A], connected in parallel to capacitor C1. The voltage $V_2$ across capacitor C2 represent the speed of the drill bit 17.

For modelling an applied time-varying frequency torque control signal, in accordance with the invention, a control current source I0 providing a time-varying frequency current value $I_0$ [A] in parallel with the current source I1 may be used, for example. However, alternatively, a control voltage source V3 providing a varying voltage value $V_3$ [V] series connected with the DC voltage source V0 may be used for modelling an applied time-varying frequency torque control signal in accordance with the invention. This, as schematically shown by dashed lines in FIG. 6. With reference to FIG. 3, the latter means that the torque variation is applied through a variation of the set speed signal ω*. The computational model of FIG. 6 may be further enhanced by explicitly modeling the drive system motor 18, for example.

The skilled person will appreciate that the plant transfer function in the spectral domain of the equivalent circuit diagram of FIG. 6 can be computed as disclosed above with reference to equations (1)-(15).

In a first approximation, a linear computer simulation model of the dynamic part of the drill string may be used. It has been found that such a linear model provides practical results with the benefit of less stringent requirements to computer processing power and storage capacities. In a more elaborate approach, with reference to FIG. 6, different sections of the drill string may be modelled by a plurality of cascaded connections of different inductances and capacitors, connected like the inductance L2 and capacitor C2, as well as different resistors R2 parallel connected to a respective capacitor, and resistors parallel connected to such inductances L2, for example, for modelling damping experienced by the drill string from contact with the drilling fluid and/or an earth formation, for example when drilling a borehole at an angle deviated from vertical.

Figure 7A:
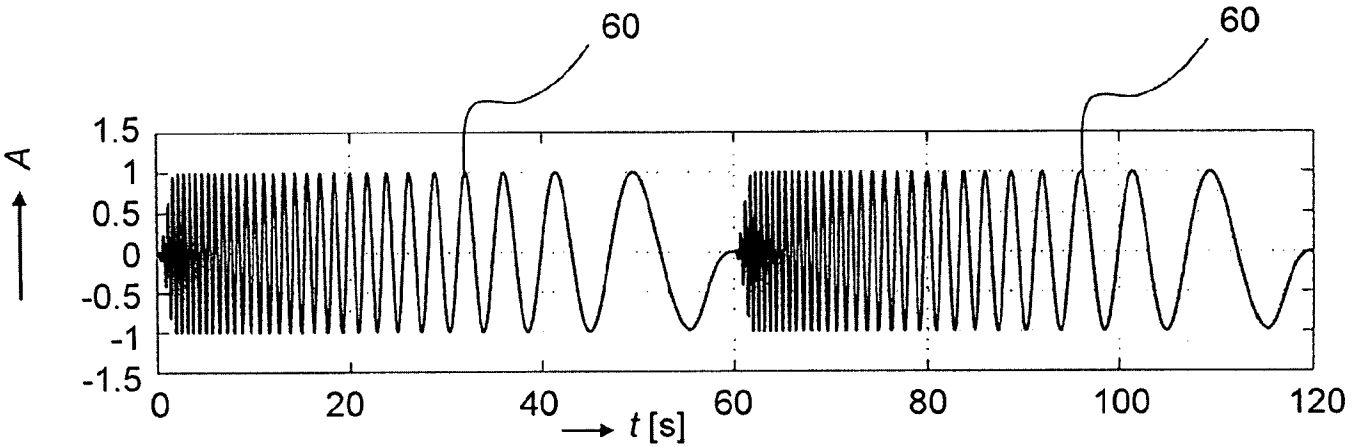
FIGS. 7*a* and 7*b* show an example of torque control signal having a time-varying signal frequency for use with the present invention.
Figure 7B:
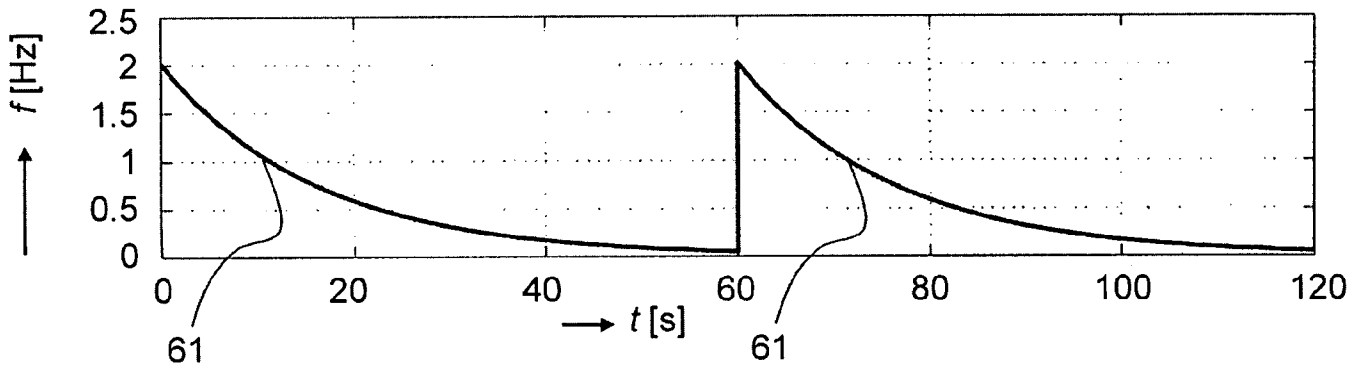

FIGS. 7*a* and 7*b* show, not to scale, an example of a sinusoidal, repetitive time-varying frequency torque control signal for use in determining the operational parameters of a practical borehole equipment. In the figures, time t [s] runs along the horizontal axis.

FIG. 7*a* shows a signal waveform 60 of a single sinusoidal, repetitive time-varying frequency torque control signal for the purpose of the invention, i.e. a sweep signal, the amplitude A of which is depicted along the vertical axis.

As can be observed from FIG. 7*a*, the amplitude of the time-varying frequency torque control signal applied increases, in a few cycles, from a zero start value to a constant amplitude value, and terminates at a zero crossing, i.e. amplitude value zero. In this way, amplitude value transitions of contiguously, repetitively applied time-varying frequency torque control signals 60 are avoided, thereby obtaining smooth frequency spectra.

The frequency f of each signal 60 decreases with an increase of time t. FIG. 7*b* illustrates the time-varying frequency f 61 of the signal of FIG. 7*a* along the vertical axis [Hz]. As can be seen from FIG. 7*a*, in this example, during a sweep with a duration of 60 seconds, the frequency f of the signal exponentially decreases from 2 Hz to 0.1 Hz.

It will be appreciated that the sweep time, amplitude and frequency values in FIGS. 7*a* and 7*b* are provided by way of example. In particular, the sweep time may be set shorter or longer than 60 seconds. In practice, the sweep time may be as long as 10 minutes, for example. Further, the repetitive signals need not necessarily to directly follow each other. In practice the next sweep may be applied after several minutes, such as 10 minutes or 15 minutes or the like.

The accuracy of the operational parameters determined with the method of the invention depends on the degree at which the frequency of the torque control signal varies over time. A relative slow frequency variation provides more accurate results than a relative fast frequency variation over time. This, because a relative slow variation provides a relative larger amount of measurement results which are less spread for matching purposes. The accuracy of the operational parameters obtained depends also on the quality factor Q of the borehole equipment. In practice, for a typical quality factor Q of borehole equipment between 5-15 the method according to the invention provides accurate results.

The frequency may vary over time in any suitable manner such as linear, exponential or in any other manner. However, it has been observed that an exponentially varying frequency over a sweep interval, either increasing or decreasing, provides an excellent coherence between the applied and measured signals while drilling commences!

In an example of the invention, for use in determining the operational parameters of a practical borehole equipment, the time-varying frequency torque control signal is built by a superposition of two time-varying frequency signals having a different time-varying frequency, such as schematically shown in FIGS. 8*a*, 8*b*, 8*c*, 8*d* and 8*e*. In the figures, time t [s] runs along the horizontal axis.

Figures 8A, 8B, 8C:
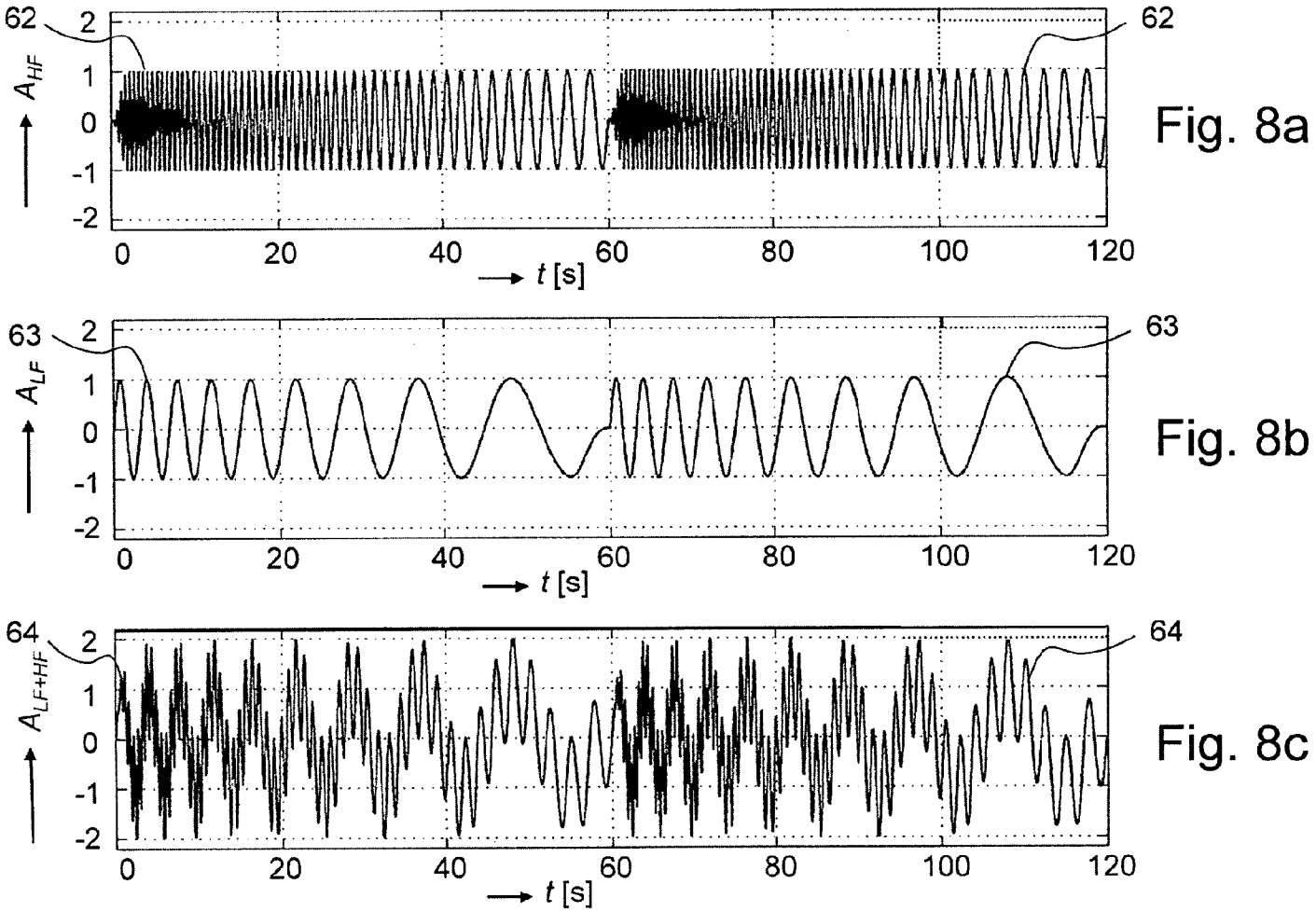
FIGS. 8*a*, 8*b*, 8*c*, 8*d* and 8*e* show another example of a torque control signal having a time-varying signal frequency for use with the present invention.

FIG. 8*a* shows, in a same manner as FIG. 7*a*, the signal waveform 62 of a first sinusoidal, repetitive, relatively fast time-varying frequency signal, termed signal$_{HF}$, having a constant amplitude $A_{HF}$ depicted along the vertical axis. FIG. 8*b* shows, in a same manner as FIG. 7*a*, the signal waveform 63 of a second sinusoidal, repetitive, relatively slow time-varying frequency signal, termed signal$_{LF}$, having a constant amplitude $A_{LF}$. FIG. 8*c* shows, in a same manner as FIG. 7*a*, the signal waveform 64 of the actual repetitive time-varying frequency torque control signal being a superposition of the signal$_{HF}$ and the signal$_{LF}$, termed signal$_{LF+HF}$, or twin frequency exponential torque control sweep signal, having an amplitude $A_{LF+HF}$.

In this example, the frequency variation of each of the signal$_{HF}$ and the signal$_{LF}$ is selected such that at the start and end of a sweep interval both signals have common zero-crossings, such to avoid amplitude transitions in the twin frequency exponential torque control sweep signal 64, as shown in FIG. 8*c*. Those skilled in the art will appreciate that in a same manner a triple or quadruple etcetera time varying frequency torque control signal may be composed, for an even improved matching.

Figure 8D:
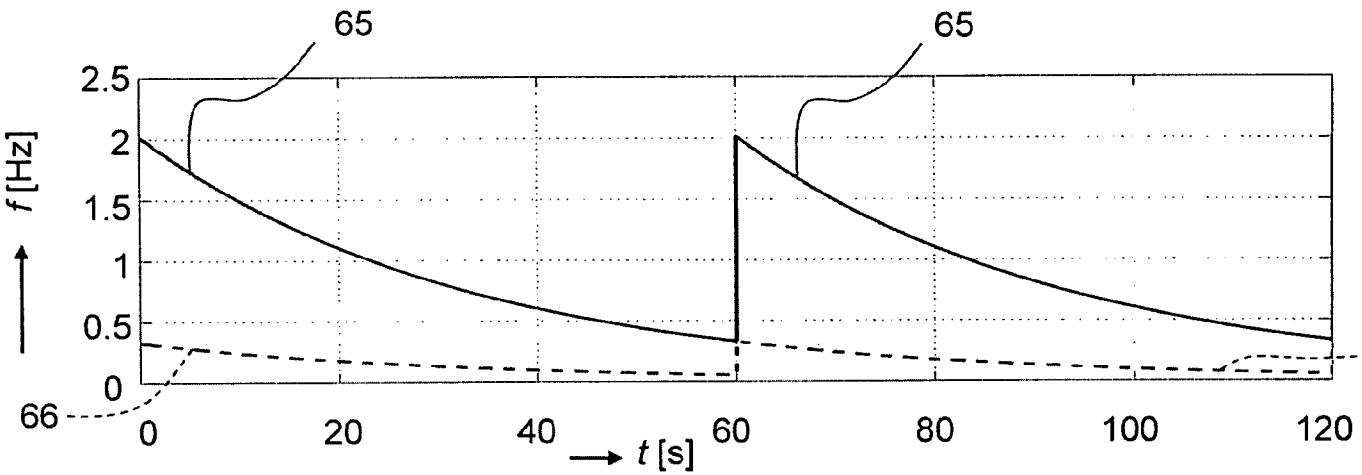

FIG. 8*d* shows, in a same manner as FIG. 7*b*, the frequency variation of the time-varying frequency of the signal$_{HF}$ 65 and the signal$_{LF}$ 66 of FIGS. 8*a* and 8*b*, respectively. The frequency f [Hz] is depicted along the vertical axis. As can be observed from FIG. 8*d*, during a sweep with a duration of 60 seconds the frequency 65 of the signal$_{HF}$ exponentially decreases from 2 Hz to 0.35 Hz, while the frequency 66 of the signal$_{LF}$, shown in dotted lines, exponentially decreases from 0.35 Hz to 0.1 Hz.

Figure 8E:
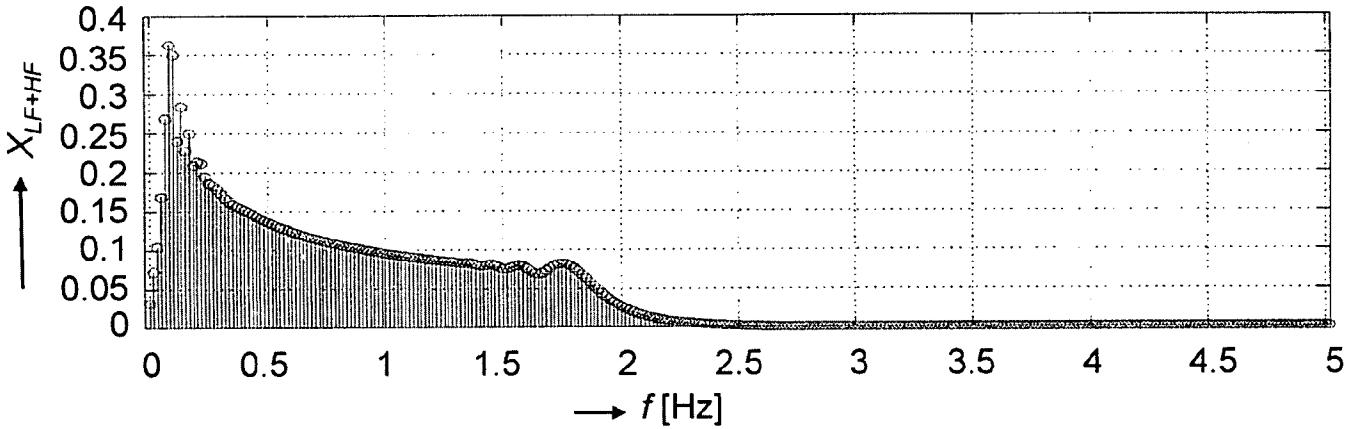

FIG. 8*e* shows the frequency spectrum of the superposed time-varying frequency signals, i.e. signal$_{LF+HF}$, shown in FIG. 8*c*, for a plurality of discrete frequency components calculated using a Fast Fourier Transform (FFT) algorithm. The frequency f [Hz] runs along the horizontal axis and the magnitude $X_{LF+HF}$ of the respective frequency components is depicted along the vertical axis of FIG. 8*e*. As can be observed, the frequency f of the superposed signal varies over a frequency range of about 0.05 Hz to about 2 Hz.

Figure 9:
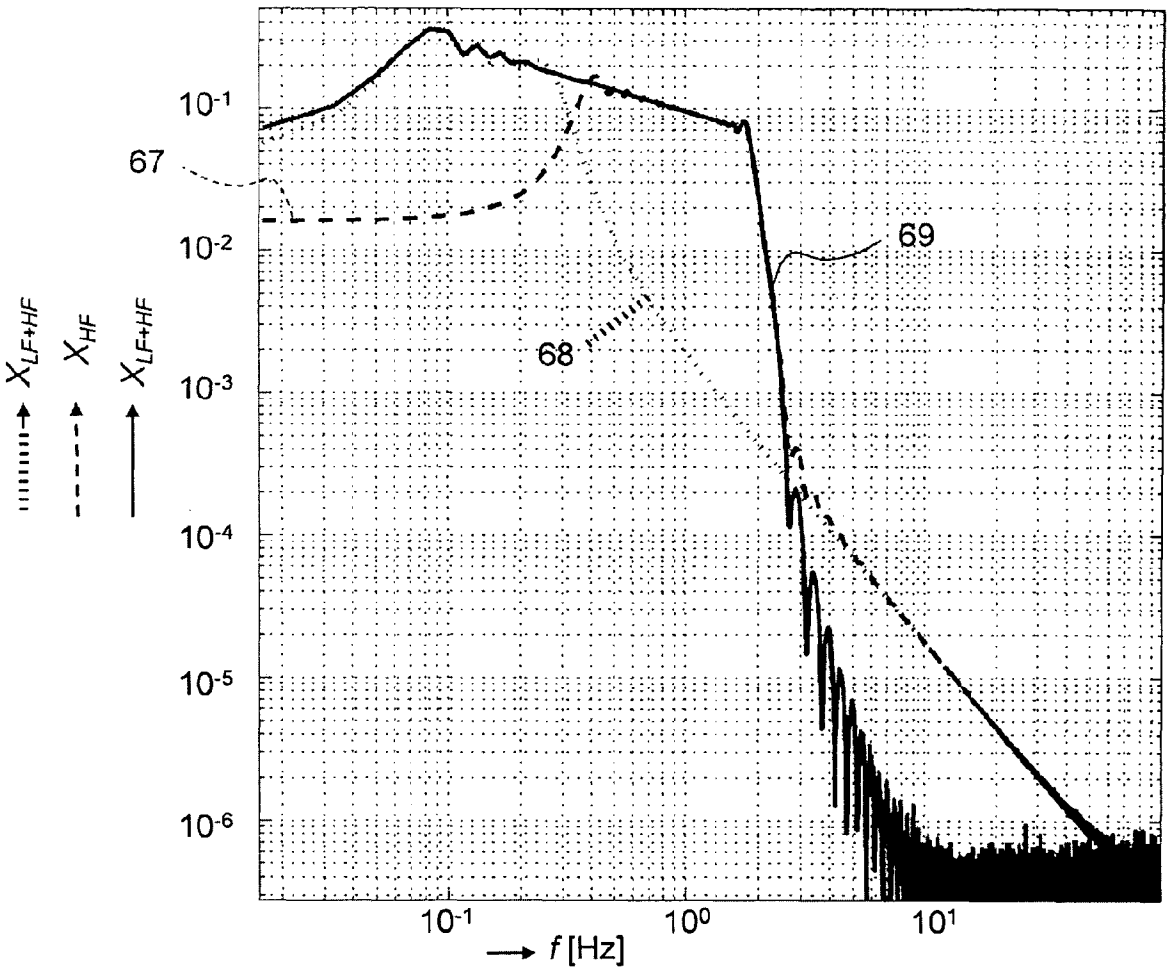
FIG. 9 shows, on a double logarithmic scale, frequency spectra of the time-varying frequency signals shown in FIGS. 8*a*, 8*b* and 8*c*.

FIG. 9 shows, on a double logarithmic scale, the frequency spectrum of each of the time-varying frequency signal$_{HF}$, the signal$_{LF}$, and the torque control signal$_{LF+HF}$ shown in FIGS. 8*a*, 8*b* and 8*c*, respectively. That is signal$_{HF}$, represented by a dashed line 67, signal$_{LF}$, represented by a dotted line 68, and the superposed signal$_{LF+HF}$, represented by a solid line 69. In FIG. 9 the frequency f [Hz] runs along the horizontal axis and the respective magnitudes $X_{HF}$, $X_{LF}$, and $X_{LF+HF}$ are depicted along the vertical axis.

Due to the fact that the signal$_{HF}$ and the signal$_{LF}$ are selected such that at the start and end of a sweep interval both signals have common zero-crossings, the superposed twin frequency sweep signal$_{LF+HF}$ is a time contiguous sweep signal having a frequency spectrum, indicated by the solid line 69, that is essentially flat in the range of about 0.05 to 2 Hz, this although the Gibbs effect of each of the time-varying frequency signals, i.e. signal$_{HF}$ and signal$_{LF}$, is relatively large.

Figure 10A:
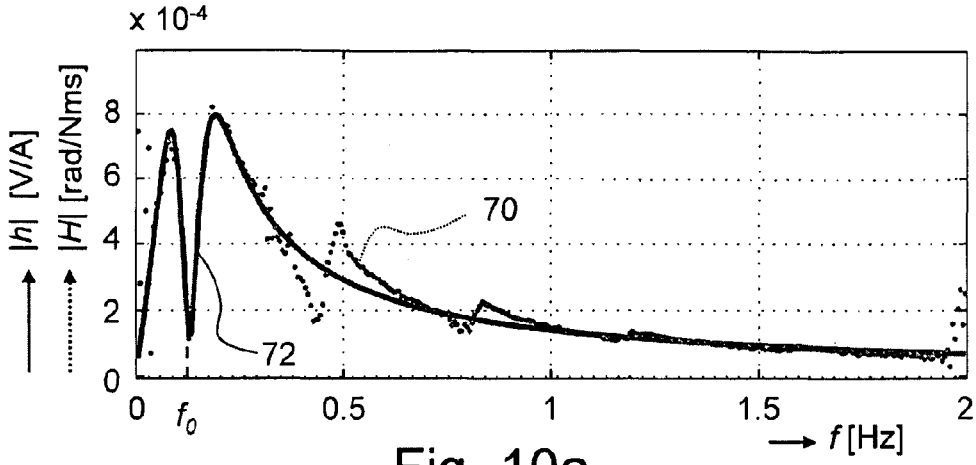
FIGS. 10*a* and 10*b* show the magnitude and phase, respectively, of an estimated torque-speed transfer function and a torque-speed transfer function computed from the computational model or equivalent circuit diagram of the borehole equipment shown in FIG. 6.
Figure 10B:
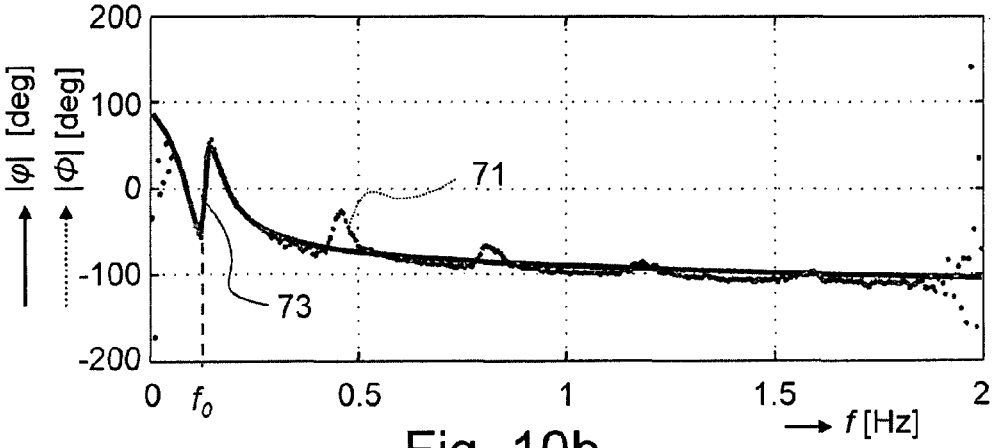

The dotted lines in FIGS. 10*a* and 10 show the magnitude |H| [rad/Nms] 70, depicted along the vertical axis of FIG. 10*a*, and phase ϕ [degrees] 71, depicted along the vertical axis of FIG. 10*b*, respectively, of an estimated torque-speed transfer function H, obtained according to equation (16) by applying a single twin frequency sweep torque control signal 65 discussed above and shown in FIG. 8*c* as a time-varying frequency torque control signal $T_s$ to an actual borehole equipment 13, and by obtaining the rotational top end drive speed ω of the drill string 12 of the borehole equipment 13.

In practice, the graphs shown in FIGS. 10*a* and 10*b* may be obtained from averaging stacked measurement results obtained by repetitively applying the twin frequency sweep signal 65 shown in FIG. 8*c* during a time period or time interval, such as a time period of 10 minutes, for example.

The solid lines in FIGS. 10*a* and 10*b* show the magnitude |h| [V/A] 72 and phase ϕ [degrees] 73, respectively, of the transfer function h of the voltage $V_1$ across capacitor C1, representing the drive speed ω at the top end 14 of the drill string 12, and the current $I_0$ of the current source I0, representing the time-varying frequency torque control signal $T_s$, in the computational model or equivalent circuit diagram of the borehole equipment 10 shown in FIG. 6 and discussed above, i.e.

$$h = \frac{V_1}{I_0} \tag{18}$$

computed for the same twin frequency sweep torque control signal as applied to the actual borehole equipment.

Matching the estimated transfer function H and the computed transfer function h such that the magnitude graphs 70 and 72, and the phase graphs 71 and 73, respectively, cover each other as much as possible, at least for the lower frequencies f, eventually results in values of the equivalent circuit components of FIG. 6, representing operational parameters of the borehole equipment. That is, inductor L2, representing the drill string and having an inductance value $L_2=1/K_s$, the capacitor C1, representing the inertia of the drive system and having a capacitance value $C_1=J_d$, the capacitor C2, representing the bottom hole assembly, having a capacitance value $C_2=J_b$, inductance value $L_1=1/K_f$ as well as the resistor values $R_1=1/C_f$ and $R_2$.

From FIGS. 10*a* and 10*b*, for the computed transfer function h when matched to the estimated transfer function H, the following operational values apply:

$K_s$=451 Nm/rad $J_d$=1190 kgm$^2$ $J_b$=667 kgm$^2$.

The resonance frequency $f_0$ of the borehole equipment can be calculated from equation (11) and $f_0=\omega_0/2\pi$, wherein π is the mathematical constant approximately equal to 3.14159. From the values of $K_s$ and $J_b$ obtained above, a resonance frequency $f_0$=0.1308 Hz is obtained. In the graphs of FIGS. 10*a* and 10*b*, this corresponds with the frequency f at which a first dip in the magnitude and phase of the transfer functions occurs, i.e. indicated by $f_0$ in FIGS. 10*a* and 10*b*.

The characteristic impedance $Z_0$ of the drill string is calculated from:

$$Z_0 = \frac{1}{\sqrt{K_s J_b}} \tag{19}$$

From the operational values obtained, a characteristic impedance $Z_0$ of 0.00182 rad/Nms is calculated.

Table 1 below shows a comparison of the drill string parameters obtained with the example of the invention described above, applying the twin frequency sweep signal shown in FIG. 8*c* during 10 minutes, and the drill string parameters provided by a spread-sheet or table or the like from the drilling operator for a particular drill string geometry of the borehole equipment 10.

TABLE 1

| | $K_s$ [Nm/rad] | $J_d$ [kgm$^2$] | $J_b$ [kgm$^2$] | $f_0$ [Hz] | $1/Z_0$ [Nms/rad] |
|---|---|---|---|---|---|
| Invention | 451 | 1190 | 667 | 0.1308 | 548 |
| Table or spread sheet | 413 | 1011 | 603 | 0.1316 | 499 |

The results obtained with the above disclosed example of the invention and the parameters provided by the drilling operator are overall within about 10% difference.

Figure 11:
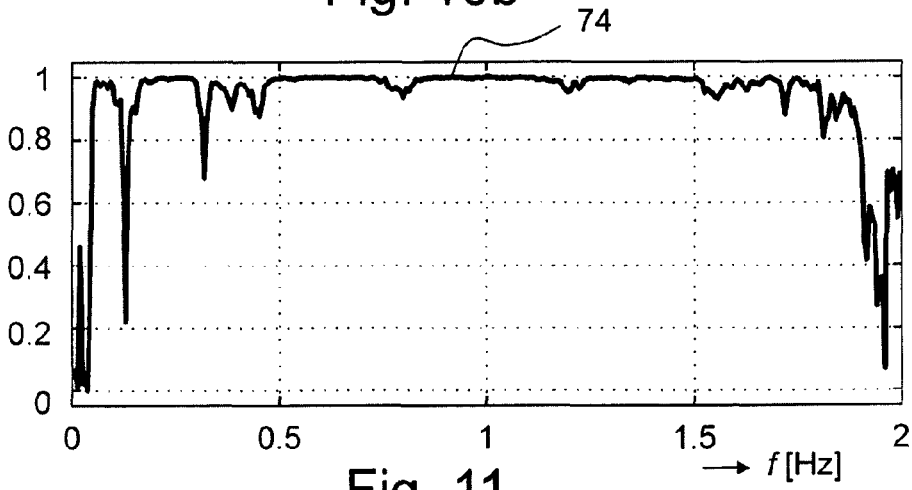
FIG. 11 shows coherence, in the spectral domain, between the applied varying torque signal applied and the obtained top end drive speed for a frequency range of interest.

Graph 74 in FIG. 11 visualizes the coherence $R_{xy}$, in the spectral domain, between the time-varying frequency torque input signal and the obtained top end drive speed output signal. In FIG. 11, the frequency f [Hz] runs along the horizontal axis and the coherence $R_{xy}$, calculated as a measure between 0 and 1 using equation (17), is depicted along the vertical axis.

On average, the calculated coherence equals or is near 1, which means that the matched transfer functions are extremely coherent. The coherence is significantly reduced at the resonance frequency $f_0$ which is caused by the fact that at the resonance frequency noise and other disturbance signals will have a relatively significant impact on the operation of the drill string. Higher modes in the torque-speed transfer function can be likewise identified in FIG. 11 from coherence dips.

The parameter values listed in Table 1 can be obtained with an even higher accuracy by using a more elaborated representative computational model for the dynamic part of the borehole equipment compared to the first order linear model of FIG. 6. For example, in the circuit diagram of FIG. 6 the drill string is modelled by a single inductor L2, connected as shown. For the purpose of the invention, as already elucidated above, different sections of the drill string may be modelled by an inductor having a suitable inductance value, a series capacitor having a suitable capacitance value and resistors parallel connected to the inductor and/or capacitor C and representing the damping experienced by the drill string. Several such sections may be modelled, taking into account different earth formation properties, the path of the drill string in the earth formation, the mechanical properties of the drill pipes, etc.

Figure 12:
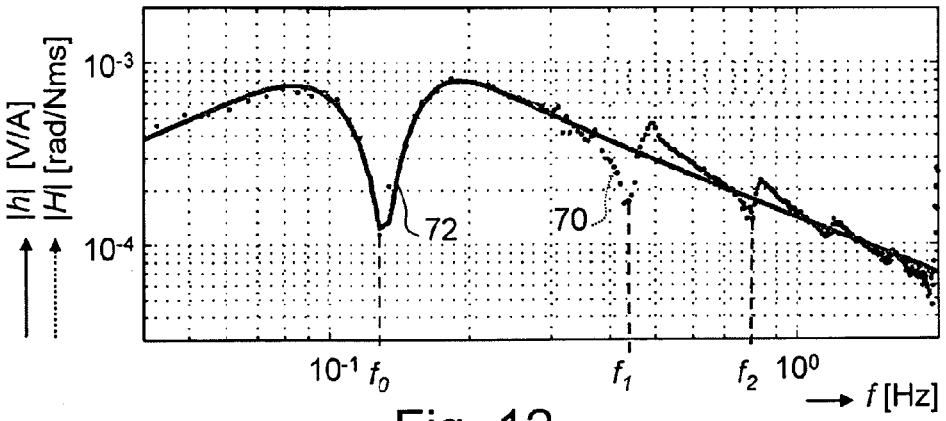
FIGS. 12, 13 and 14 show the magnitudes of matched estimated and computed transfer functions obtained in accordance with the invention for a first, a second and a third mode, respectively.
Figure 13:
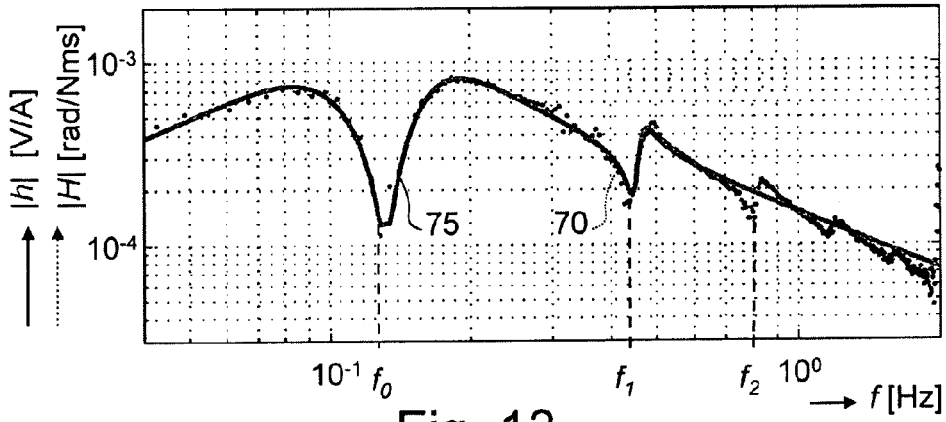
Figure 14:
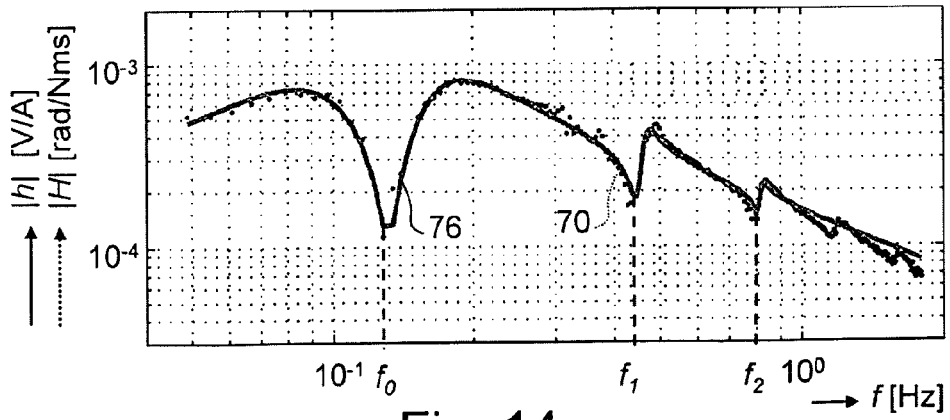

By way of comparison, FIG. 12, FIG. 13 and FIG. 14 show the magnitudes |h| and |H| of matched transfer functions h and H obtained as described above with reference to FIG. 10*a*, not only taking into account the first mode 72 at frequency $f_0$ but also a second mode 75 at frequency $f_1$ and a third mode 76 at frequency $f_2$, respectively. FIG. 12 equals FIG. 10*a*, however the magnitudes |h| 72 and |H| 70 of the transfer functions h and H, and the frequency f are depicted on a double logarithmic scale.

From FIGS. 12, 13 and 14 it can be easily observed that with a more elaborate matching and representative computational model of the dynamic part of the borehole equipment, also higher order effects can be estimated, among others for calculating damping which a drill string encounters during drilling. The resistance value $R_2$ of resistor R2 as shown in the computational model of FIG. 6 is a measure for the mechanical damping the drill string encounters, i.e. damping as result of the drilling mud, engagement of the drill string and the wall of the borehole, for example caused by lateral deflections of the drill string due to a compressive force exerted at the drill string.

With reference to computational model shown in FIG. 6, for example, one may appreciate that while the operational parameters of the computational model are determined, various signal analyzing and processing techniques may be applied to calculate and simulate the impact of changes in control signals applied. Such as, for example, the impact at the actual operation speed of the drill bit, represented by a voltage across the capacitor C2, by a change in the set top end drive speed $V_0$.

Excellent results can be obtained, among others, by using a wave propagation model. This model is, in particular, appropriate for a more accurate and representative modeling of the drill string.

In an example of a wave propagation model, the drill string 12 is modeled as a uniform mechanical type transmission line model with operational parameters comprised by a viscous borehole wall damping per unit length, internal material damping per unit length, length of the drill string, and polar moment of inertia. The BHA 11 and drill bit 17 are represented by an inertia and friction concentrated or effective at the bottom end 13. At the earth surface, the borehole equipment is represented by the top drive inertia and time delay in the drive system 15, such as a time delay introduced by variable frequency drive equipment powering the drive system motor 18. It has been found that the eight operational parameters mentioned can be accurately determined with the method according to the invention, while during an actual drilling operation the performance of the borehole equipment can be very accurately calculated and simulated from this particular transmission line model.

Figure 15:
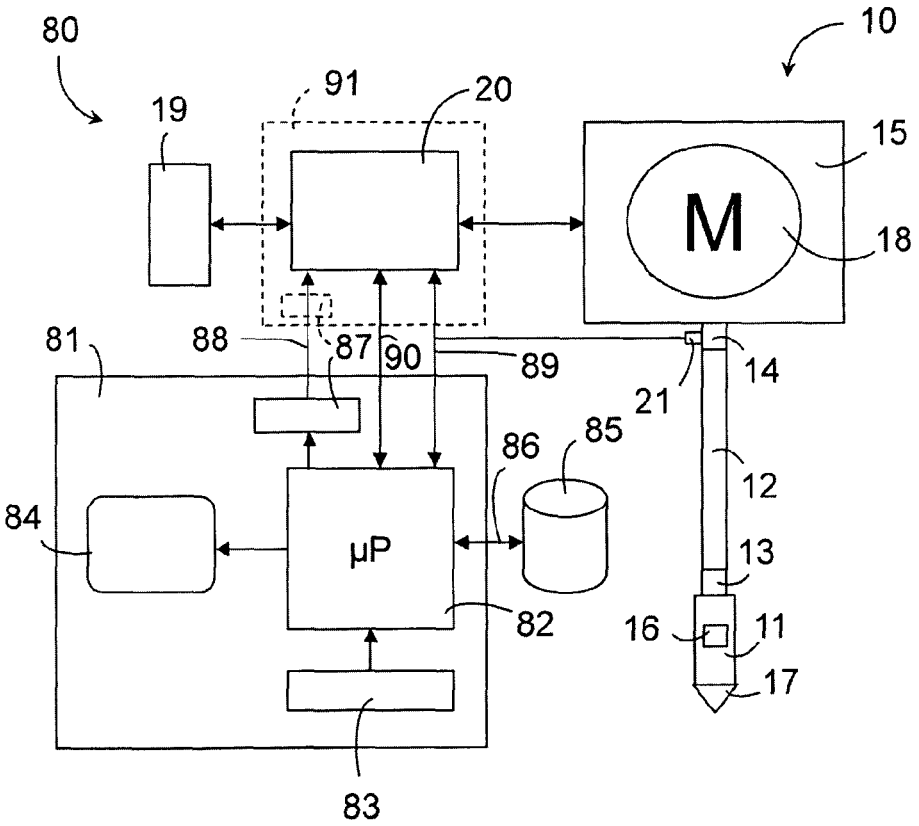
FIG. 15 is a schematic representation of borehole equipment equipped for operating in accordance with the invention, having an electronic speed controller for controlling rotational speed of the drive system.

FIG. 15 schematically shows a device 80 for automatically determining operational parameters of a computational model of borehole equipment 10, operated either on-bottom or off-bottom. In addition to the borehole equipment 10 shown in FIG. 1, an operational parameter control system 81 is provided. The control system 81 comprises a computer or electronic processing device 82, an input interface 83, such as keyboard, a touch screen or the like, for selecting a representative computational model of the dynamic part of the borehole equipment 10 and for setting known parameter values, such as tuning parameters of the speed controller 20, if any, of the borehole equipment 10. Operational parameters and transfer functions estimated and calculated by the processing device 82 may be optionally provided at an output interface 84, such as a graphical display, a printer or plotter, or a data evaluation module for evaluating the operational parameters obtained. The computational model, operational and tuning parameters and other values in accordance with the invention, may be stored at and retrieved from a database 85, accessible from the control system 81. The database 85 may be remote from the control system 81 and connected by a communication network 86, for example.

The control system 81 comprises a signal generator unit 87 arranged for generating a time-varying frequency signal, such as a single or twin frequency sweep signal shown in FIG. 7*a* and FIG. 8*c*, respectively, which time-varying frequency signal is applied as a torque control signal to the speed controller 20 through a data input 88. Operation of the signal generator unit 87 is controlled by the processing device 82. The rotational top end speed of the drill string 12, for example measured at its top end 14 by a speed indicator or speed sensor 21, is provided 89 to the processing device 82. Signal generator units for use with the present invention are known to those skilled in the art and need no further elaboration. The signal generator unit 87 may also be an integral part of the processing device 82. It is noted that the time-varying frequency signal of the generator unit 87 may also be directly applied to the drive system 15, instead of applying the time-varying frequency signal at an input of the speed controller 20.

The processing device 82 is suitably programmed for automatically determining the tuning parameters of the dynamic part of the borehole equipment by controlling the signal generator unit 87 such that a torque provided by the drive system 15, while driving the drill string 12, is varied over a time period and by measuring the rotational drive speed of the drill string 12 provided by the speed indicator or speed sensor 21 during this time period. Preferably, the torque provided to the drive system 15 is varied in a known manner over the time period or time interval, this to improve coherence.

The processing device 82 is further programmed to calculate an estimated torque-speed transfer function from the varying torque signal applied and the measured rotational drive speed, and for determining the operational parameters of the borehole equipment 10 and tuning parameters for the speed controller 20 by matching the estimated torque-speed transfer function and a torque-speed transfer function computed from a selected representative computational model of the borehole equipment 10, i.e. the speed controller, drive system, drill string and bottom hole assembly. Tuning parameters obtained from operational parameters thus determined, may be directly fed to the speed controller 20 through a data input/output 90 for setting the speed controller 20 in a desired control mode, dependent on the tuning parameters thus obtained.

In further examples, the processing device 82 may be suitably programmed to operate in accordance with the method of the invention and the attached claims.

An electronic controller 91 may be provided comprising, besides the speed controller 20, a data input 88 for receiving a time-varying frequency signal as a torque control signal to the speed controller 20, a data input/output 90 for receiving tuning parameters and/or for providing feedback to the control system 81 and comprising, instead of or in addition to the control system 81, the signal generator unit 87, as schematically indicated by broken lines in FIG. 15.

The control system 81 may be arranged or disposed remote from the borehole equipment 10, such that the connections 88, 89 and 90 with the speed controller 20 or the electronic controller 91 may be arranged as a single data network connection or a connection with a telecommunication network, either wired or wireless.

The present invention is not limited to the embodiments as disclosed above, and can be modified and enhanced by those skilled in the art within the scope of the present invention as disclosed in the appended claims, without having to apply inventive skills.

The invention claimed is:

1. A method of computer controlled determination of operational parameters of a computational model of borehole equipment for drilling a borehole in an earth formation, said borehole equipment comprising a rotational drive system, a drill string having a bottom hole assembly comprising a drill bit and a top end coupled to said rotational drive system, and a speed controller for controlling rotational drive speed of said drive system, the method comprising the steps of:

controlling said drive system such that a torque provided by said drive system while driving said drill string is varied over a time period providing a limited rotational top end drive speed variation of said drill string;

obtaining rotational top end drive speed of said drill string during said time period;

calculating from said varying torque and said obtained rotational top end drive speed an estimated torque-speed transfer function;

matching said estimated torque-speed transfer function and a torque-speed transfer function computed from said computational model of said borehole equipment, and determining said operational parameters from said matched estimated torque-speed transfer function and said computed torque-speed transfer function.

2. The method according to claim 1, wherein said torque provided by said drive system is varied by applying a torque control signal having a time-varying signal frequency.

3. The method according to claim 1, wherein said torque provided by said drive system is varied by superposing at a set torque control signal a torque control signal having a time-varying signal frequency.

4. The method according to claim 1, wherein said torque provided by said drive system is varied by applying a torque control signal having an exponentially varying signal frequency over a set time interval.

5. The method according to claim 1, wherein said torque provided by said drive system is varied by applying a torque control signal being a superposition of a plurality of signals over a set time interval, each signal having a different varying signal frequency over said time interval.

6. The method according to claim 1, wherein said matching comprises matching amplitude and phase of said estimated and equivalent torque-speed transfer functions.

7. The method according to claim 1, wherein said operational parameters are determined if said varying torque and said obtained top end drive speed reach a predetermined degree of coherence.

8. The method according to claim 1, further comprising determining a degree of coherence of said varying torque and said obtained top end drive speed, and wherein if said varying torque and top end drive speed lack a predetermined degree of coherence, said steps of controlling, obtaining, calculating, and matching are repeated and said operational parameters are determined from said repetition.

9. The method according to claim 1, wherein said limited variation of said rotational top end drive speed of said drill string is less than 15% of a set rotational top end drive speed of said drill string.

10. The method according to claim 1, wherein said borehole equipment is operated with said bottom hole assembly off-bottom.

11. The method according to claim 1, wherein said computational model includes representation of an actual earth formation in which said borehole is drilled.

12. The method according to claim 1, wherein damping encountered by said drill string is determined from said matched estimated torque-speed transfer function and said computed torque-speed transfer function.

13. The method according to claim 1, wherein said determining of said operational parameters is repeated after part of said drill string has been modified.

14. The method according to claim 1, wherein said determining of said operational parameters is periodically repeated.

15. The method according to claim 1, wherein said computational model is at least one of a state-space model, an equivalent electric circuit model, an equivalent mechanical torsional spring-inertia model, a segmented model, a continuous-time model, a discrete-time model, a frequency domain model, and a wave propagation model, including a mechanical and electrical type transmission line model.

16. The method according to claim 1, performed in a computer system separate from said borehole equipment.

17. The method according to claim 1, wherein tuning parameters are provided to said speed controller from determined operational parameters.

18. A device for computer controlled determination of operational parameters of a computational model of borehole equipment for drilling a borehole in an earth formation, said borehole equipment comprising a rotational drive system, a drill string having a bottom hole assembly comprising a drill bit and a top end coupled to said rotational drive system, and a speed controller for controlling rotational drive speed of said drive system, said device comprising a computer controlled operational parameter control system operating for:

controlling said drive system such that a torque provided by said drive system while driving said drill string is varied over a time period providing a limited rotational top end drive speed variation of said drill string;

obtaining rotational top end drive speed of said drill string during said time period;

calculating from said varying torque and said obtained rotational top end drive speed an estimated torque-speed transfer function;

matching said estimated torque-speed transfer function and a torque-speed transfer function computed from said computational model of said borehole equipment, and determining said operational parameters from said matched estimated torque-speed transfer function and said computed torque-speed transfer function.

19. The device according to claim 18, wherein said computer controlled operational parameter control system is arranged for determining said operational parameters.

20. The device according to claim 18, wherein said computer controlled operational parameter control system operatively connects to said speed controller and is arranged for providing tuning parameters to said speed controller from determined operational parameters.

21. The device according to claim 18, wherein said computer controlled operational parameter control system comprises a signal generator unit arranged for generating a time-varying frequency signal for varying the torque provided by said drive system over a time period.

22. An electronic controller for controlling rotational drive speed of a rotational drive system of borehole equipment for drilling a borehole in an earth formation, said borehole equipment comprising a drill string having a bottom hole assembly comprising a drill bit and a top end coupled to said rotational drive system, and a speed controller for controlling rotational drive speed of said drive system, said electronic controller comprising a data input for receiving data for providing a time-varying frequency torque control signal and a data input/output for receiving tuning parameters obtained from operational parameters determined in accordance with the method according to claim 1.

23. The electronic controller according to claim 22, comprising a signal generator unit for providing said time-varying frequency torque control signal.

24. A borehole equipment for drilling a borehole in an earth formation, said borehole equipment comprising a rotational drive system, a drill string having a bottom hole assembly comprising a drill bit and a top end coupled to said rotational drive system, a speed controller for controlling rotational drive speed of said drive system, and a device for computer controlled determination of operational parameters operatively connected to said speed controller for providing tuning parameters to said speed controller, in accordance with claim 18.

* * * * *